US007174634B2

(12) United States Patent
Morikawa et al.

(10) Patent No.: US 7,174,634 B2
(45) Date of Patent: Feb. 13, 2007

(54) METHOD FOR PRODUCING A FLUID TREATMENT DEVICE HAVING A HONEYCOMB MEMBER

(75) Inventors: Akinobu Morikawa, Nishikamo-gun (JP); Tohru Irie, Nagoya (JP)

(73) Assignee: Sango Co., Ltd., Nagoya (JP)

( * ) Notice: Subject to any disclaimer, the term of this patent is extended or adjusted under 35 U.S.C. 154(b) by 129 days.

(21) Appl. No.: 10/853,282

(22) Filed: May 26, 2004

(65) Prior Publication Data

US 2004/0237305 A1 Dec. 2, 2004

(30) Foreign Application Priority Data

May 29, 2003 (JP) ..... 2003-151902

(51) Int. Cl.
*B21D 51/16* (2006.01)
*B21D 39/00* (2006.01)

(52) U.S. Cl. ..... 29/890; 29/896.62; 29/508; 29/515; 29/516

(58) Field of Classification Search ..... 29/890, 29/896.62, 580, 515, 508
See application file for complete search history.

(56) References Cited

U.S. PATENT DOCUMENTS

| | | | | |
|---|---|---|---|---|
| 4,397,817 | A | 8/1983 | Otani et al. | |
| 4,400,860 | A * | 8/1983 | Nonnenmann et al. | 29/890 |
| 5,118,476 | A | 6/1992 | Dryer et al. | |
| 5,953,817 | A * | 9/1999 | Watanabe et al. | 29/890 |
| 6,233,993 | B1 | 5/2001 | Irie | |
| 6,381,843 | B1 | 5/2002 | Irie et al. | |
| 6,613,446 | B1 * | 9/2003 | Peters et al. | 428/593 |
| 6,769,281 | B2 * | 8/2004 | Irie et al. | 72/121 |
| 2003/0194357 | A1 * | 10/2003 | Lancaster et al. | 422/177 |
| 2005/0276732 | A1 * | 12/2005 | Saito | 422/179 |

FOREIGN PATENT DOCUMENTS

| | | |
|---|---|---|
| JP | 47-29836 | 8/1972 |
| JP | 6-71560 | 3/1994 |
| JP | 11-58109 | 3/1999 |

(Continued)

OTHER PUBLICATIONS

U.S. Appl. No. 10/375,096, filed Feb. 28, 2003, Irie et al.

(Continued)

*Primary Examiner*—David P. Bryant
*Assistant Examiner*—Sarang Afzali
(74) *Attorney, Agent, or Firm*—Oliff & Berridge, PLC

(57) ABSTRACT

The present invention is directed to a method for producing a fluid treatment device having a honeycomb member in a metallic cylindrical housing with a shock absorbent member wrapped around the honeycomb member. The method comprises the steps of (1) inserting the honeycomb member with the shock absorbent member wrapped around the honeycomb member, into the cylindrical housing, (2) forming a necking portion on at least one end portion of the cylindrical housing, with a body portion thereof being clamped, and (3) reducing a diameter of at least a part of the cylindrical housing with the shock absorbent member received therein, together with the shock absorbent member, to such an extent that a desired inner diameter of the part of the cylindrical housing is provided enough to cause the shock absorbent member to produce a desired holding pressure for holding the honeycomb member in the cylindrical housing.

2 Claims, 18 Drawing Sheets

FOREIGN PATENT DOCUMENTS

| | | |
|---|---|---|
| JP | A 2000-045762 | 2/2000 |
| JP | 2001-25826 | 1/2001 |
| JP | 2001-107725 | 4/2001 |
| JP | 2002-18539 | 1/2002 |
| JP | 2002-178045 | 6/2002 |
| JP | 2002-224923 | 8/2002 |

OTHER PUBLICATIONS

U.S. Appl. No. 10/637,677, filed Aug. 11, 2003, Irie et al.

* cited by examiner

METHOD FOR PRODUCING A FLUID TREATMENT DEVICE HAVING A HONEYCOMB MEMBER

BACKGROUND OF THE INVENTION

1. Field of Invention

The present invention relates to a method for producing a fluid treatment device having a honeycomb member in a metallic cylindrical housing, with a shock absorbent member wrapped around the honeycomb member, and more particularly a method of producing a catalytic converter for holding a catalyst substrate with a shock absorbent mat wrapped around it in a cylindrical housing.

2. Description of Related Arts

In recent exhaust parts for use in an automotive vehicle, such as a catalytic converter, a diesel particulate filter (abbreviated as DPF) and the like, it is required to hold a catalyst substrate or filter accommodated in a cylindrical housing, firmly. In order to reduce the diameter of the housing to compress an absorbent member after having inserted the catalyst substrate or filter into the housing, a so-called sizing process is getting popular.

With respect to a spinning apparatus capable of forming a necking portion which is at least one of offset from, oblique to and skewed from a body portion (intermediate portion) of a metallic workpiece including the cylindrical housing, Japanese Patent Laid-open Publication No.2001-25826, which corresponds to the U.S. Pat. No. 6,233,993, proposes a method for forming a changed diameter portion of a workpiece by spinning which comprises supporting the workpiece so that a central axis of the portion to be processed is aligned with one of a plurality of forming target axes, the plurality of forming target axes being provided on the basis of a plurality of target processed portions of the workpiece changed from the unprocessed portion to a final target processed portion of the workpiece with a central axis of the final target processed portion being at least one of offset from, oblique to and skewed from a central axis of the unprocessed portion, and molding the portion to be processed by a spinning process so that the central axis of the portion to be processed is matched to each forming target axis of the plurality of forming target axes, and simultaneously changing the diameter of the portion to be processed, in each forming target axis.

As for another spinning apparatus of a type with a workpiece fixed, it is described in Japanese Patent Laid-open Publication No.2002-18539 that a pipe to be formed is clamped by a clamp mechanism, and a drawing tool is movably supported in a radial direction on a tool table mounted on a rotary shaft. With the drawing tool moved in a radial direction, the drawing work is performed. At the same time, by rotating the tip end of the pipe to be formed at a predetermined angle by rotating means, the drawing tool can be applied to the tip end of the pipe which is oblique by the predetermined angle to the axis of the pipe. Also, it is described that the clamping mechanism for the pipe to be formed is provided with moving means for displacing the center line of the pipe to be formed against the center line of the main shaft, and rotating means for rotating it by a predetermined angle, and described that with each means operated, the tip end of the pipe can be held at a desired angle to a working axis.

Also, it is described in Japanese Patent Laid-open Publication No.2002-178045 that according to the prior methods for producing a catalytic converter, as a press machine and a spinning machine are required, each machine costs much and a certain space for placing each machine is required, and that as a workpiece is required to be installed on and removed from each of the press machine and spinning machine, and further required to be transferred from the press machine to the spinning machine, so that its production efficiency is decreased. In order to solve this problem, it is described that stuffing means for stuffing a catalyst substrate having a holding member mounted around its outer periphery, in its axial direction, into a holding cylinder supported on a main shaft, the axial line of which is arranged to be approximately matched with the axial line of the main shaft, on the machine body of the spinning machine for the catalytic converter. And, it is described that the main shaft 53 with its axial line directed to the other end in the horizontal direction is rotatably mounted on the main axis body 52. The main shaft 53 is arranged to be rotated by a driving source such as a motor (not shown). On the tip end of the main shaft 53, is mounted collet chuck 54 having three or four claws, by which the outer periphery of fitting portion 21 of a holding cylinder 2 (material 2') is clamped to be fixed.

With respect to workpiece clamp means, it is described in an English abstract of Japanese Patent Laid-open Publication No.11-58109 (supplied from the esp@cenet database) that in a collet chuck for a machine tool, which is able to hold or release a work 1, a main body housing 2 is provided with a work inserting hole 3 penetrating up to both front and rear surfaces of the housing 2. A ring-shaped and slotted fastening metal fitting 4, which is able to hold/grip the outer surface of the work 1 that was inserted into the inside of the hole 3, is arranged within the work inserting hole 3. A sliding tool 5 is provided between the work inserting hole 3 and the fastening metal fitting 4. In this case, the sliding tool 5 can slide within the work inserting hole 3 and in the direction of the axis of the hole 3. Thus, the work 1 can be fastened by the fastening metal fitting 4 since the sliding tool 5 fastens the outer surface of the fastening metal fitting 4 inward when the sliding metal fitting 4 slides in one direction, while the fastening to the fitting 4 can be released when the fitting 4 slides in the other direction.

Also, it is described in an English abstract of Japanese Patent Laid-open Publication No.2002-224923 (supplied from the esp@cenet database) that in the pipe clamp unit which receives, fixes, and holds a pipe 4 in a round hole **10*a* formed by an upper and a lower frames 1 and 2, a plurality of fluid cylinders 11 whose rods are arranged around the round hole 10*a* of the upper and lower frames 1 and 2 radially towards the center of the round hole, and moving means 13 which move the cylinders in a radius direction of the round hole are provided. And, it is described in an English abstract of Japanese Patent Laid-open Publication No.60-71560 (supplied from the esp@cenet database) that an automatic centering and center rest for positioning so as to stop the advance of a piston rod 32 of a hydraulic cylinder 31 opening or closing this automatic centering and center rest constituted so as to enable two claws 28, 29 to grasp a work W concentrically by means of contact with a cam by a feed screw 37** to be rotated. And, this publication discloses an automatic centering mechanism having the same structure as the one disclosed in Japanese Patent Publication for Opposition No.47-29836 cited as a prior art.

Furthermore, there is disclosed in Japanese Patent Laid-open Publication No.2001-107725, which corresponds to the U.S. Pat. No. 6,381,843, a method for producing a catalytic converter by reducing a diameter of a cylindrical member, together with a shock absorbent member, to hold therein a substrate catalyst, according to a spinning process using a plurality of spinning rollers revolved about the cylindrical member.

According to the apparatuses as disclosed in the Japanese Publication Nos.2001-25826 and 2002-18539, a workpiece (cylindrical housing) is clamped by a clamp device moving horizontally and rotating about a vertical axis, and the spinning process is performed, with the relative positions between the workpiece and the spinning rollers being adjusted. It is required, therefore, to hold the workpiece surely by the clamp device. Especially, in the case where a necking portion is to be formed by the spinning process, on an end portion of the workpiece with its body portion already formed (reduced in diameter), the clamped state of the workpiece becomes an important issue to be observed.

With respect to the method for sizing the cylindrical housing, it is desirable to provide an amount to be reduced in diameter for producing a most appropriate pressure, in view of material error among the substrate, mat and outer cylinder, and then to reduce a part of the outer cylinder holding therein the substrate by that amount. Therefore, the diameter of the outer cylinder formed by the sizing process includes individual error (difference of a few millimeters for ordinary catalytic converter).

Furthermore, with respect to the exhaust parts as described above, generally, the necking process is applied to at least one end portion of the parts, and the spinning process is appropriate for the necking process. The necking process (to the exhaust parts) is a process for reducing the end portion of the outer cylinder (cylindrical housing) in diameter to form a gradually varied diameter (tapered) portion, and form a small diameter cylindrical portion in a body, to be connected with other parts. In case of the necking process, when the spinning process is applied to the end portion of the workpiece with the sizing process applied thereto, it is required to clamp the sized body portion (intermediate portion) of the workpiece by a clamp device. In this case, the body portion has the aforementioned individual error caused in its outer diameter when the sizing process was applied. In general, the clamp device has split dies divided into upper and lower dies, each having a holding surface of a half cylindrical surface, which is hardly follow up the error of even a few millimeters in diameter. Consequently, a clearance is produced due to the difference in radius of curvature between each die and the body portion of the work piece, whereby the contacting area between them is reduced to result in decrease of the clamping force.

According to the prior co-axial spinning process with the workpiece fixed, it is sufficient to prevent the workpiece from rotating and moving axially. Therefore, the aforementioned clamp device may be capable of clamping the workpiece appropriately during the necking process. In contrast, according to the spinning process for forming the end portion of the workpiece to provide the necking portion which is at least one of offset from, oblique to and skewed from the body portion of the workpiece, relatively large clamping force is required comparing with the co-axial spinning process, because bending force and shearing force are applied to the workpiece during the spinning process as described above.

However, according to the spinning apparatus having the prior clamp devices including those as explained above, it is extremely difficult to form the end portion of the workpiece to provide the necking portion which is at least one of offset from, oblique to and skewed from the body portion of the workpiece, holding firmly the body portion of the workpiece which was already formed by the sizing process. For example, although the clamp device as disclosed in the Japanese Publication No.2002-178045 has the same centering function as that of the clamp device having the upper and lower dies, it can not automatically follow up the differences in diameter of the workpieces. Basically, it is of a type for supporting one end of the workpiece, so that it is impossible to penetrate a collet chuck so as to clamp the body portion of the workpiece. In order to apply the necking process to opposite end portions of the workpiece, therefore, it is required to change the arrangement of the clamp device and the workpiece. Thus, even if the prior clamp devices were employed in the prior spinning process, the aforementioned issue could not be solved. Furthermore, although the automatic centering mechanisms as disclosed in the Japanese Publication Nos.6-71560 and No.47-29836 may be used for different objects to be clamped, it is difficult to ensure a sufficient clamping force for clamping the body portion of the workpiece, in the spinning process for forming the end portion of the workpiece to provide the necking portion which is at least one of offset from, oblique to and skewed from the body portion of the workpiece.

SUMMARY OF THE INVENTION

Accordingly, it is an object of the present invention to provide a method for producing a fluid treatment device having a honeycomb member in a metallic cylindrical housing, with a shock absorbent member wrapped around the honeycomb member, capable of forming a necking portion on an end portion of the cylindrical housing, with a body portion thereof being clamped surely, and reducing a diameter of the cylindrical housing appropriately.

And, it is another object of the present invention to provide a method for producing a fluid treatment device having a honeycomb member in a metallic cylindrical housing, with a shock absorbent member wrapped around the honeycomb member, capable of forming an end portion of the cylindrical housing to provide a necking portion which is at least one of offset from, oblique to and skewed from a body portion of the cylindrical housing reduced in diameter, with the reduced body portion thereof being clamped by a sufficient clamping force.

In accomplishing the above and other objects, the method comprises the steps of (1) inserting the honeycomb member with the shock absorbent member wrapped around the honeycomb member, into the cylindrical housing, (2) forming a necking portion on at least one end portion of the cylindrical housing, with a body portion thereof being clamped, and (3) reducing a diameter of at least a part of the cylindrical housing with the shock absorbent member received therein, together with the shock absorbent member, to such an extent that a desired inner diameter of the part of the cylindrical housing is provided enough to cause the shock absorbent member to produce a desired holding pressure for holding the honeycomb member in the cylindrical housing.

In the method as described above, the honeycomb member with the shock absorbent member wrapped around it may be stuffed into the cylindrical housing.

The method may comprise the steps of (1) inserting the honeycomb member with the shock absorbent member wrapped around the honeycomb member, loosely into the cylindrical housing, (2) reducing a diameter of at least a part of the cylindrical housing with the shock absorbent member received therein, together with the shock absorbent member, to such an extent that an outer diameter of the part of the cylindrical housing equals a predetermined diameter, (3)

forming a necking portion on at least one end portion of the cylindrical housing, with the reduced part thereof being clamped, and (4) reducing a diameter of at least the part of the cylindrical housing with the shock absorbent member received therein, together with the shock absorbent member, to such an extent that an inner diameter of the part of the cylindrical housing is provided enough to cause the shock absorbent member to produce a desired holding pressure for holding the honeycomb member in the cylindrical housing.

In the method as described above, the honeycomb member with the shock absorbent member wrapped around the honeycomb member may be inserted into the cylindrical housing, and held therein by a couple of supporting members, which are movably disposed away from and close to opposite ends of the honeycomb member along a longitudinal axis of the cylindrical housing, respectively, and contact the opposite ends of the honeycomb member to hold the honeycomb member in the cylindrical housing when reducing the diameter of the cylindrical housing. Therefore, the honeycomb member with the shock absorbent member wrapped around it may be inserted into the cylindrical housing, with a clearance remained between the shock absorbent member and the cylindrical housing.

In the methods as described above, preferably, the desired inner diameter of the cylindrical housing is provided, on the basis of a relationship between an axial load applied to the honeycomb member and an inner diameter of the cylindrical housing, which relationship is obtained by applying the axial load to the honeycomb member so as to move the honeycomb member along a longitudinal axis of the cylindrical housing by a predetermined distance, and monitoring the axial load applied to the honeycomb member.

BRIEF DESCRIPTION OF THE DRAWINGS

The above stated object and following description will become readily apparent with reference to the accompanying drawings, wherein like reference numerals denote like elements, and in which.

DESCRIPTION OF THE PREFERRED EMBODIMENTS

Figure 1:
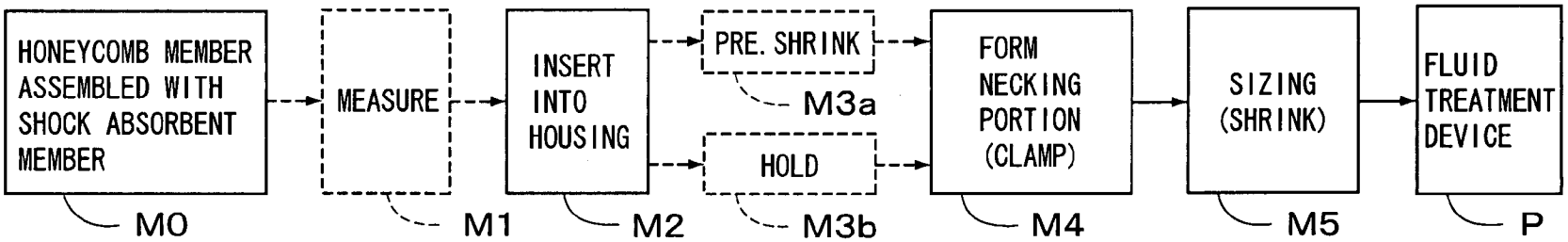
FIG. 1 is a block diagram showing processes of a method for producing a fluid treatment device having a honeycomb member, according to the present invention.

Referring to FIG. 1, there is shown a block diagram with respect to a method for producing a fluid treatment device having a honeycomb member in a metallic cylindrical member with a shock absorbent member wrapped around the honeycomb member, according to the present invention. As an embodiment of the method, methods for producing a catalytic converter for use in an exhaust gas purifying device will be explained later with reference to FIGS. 2–23. As shown in FIG. 1, at the outset, according to an assembling process (M0), a shock absorbent member is wrapped around a honeycomb member, and these members are inserted into a cylindrical housing loosely with a clearance remained against it, or stuffed into it with a small compressing force being applied in an inserting process (M2). In general, the assembling process (M0) is performed separately, and then a measurement process (M1) is performed with respect to a unit assembled in advance (as indicated by UT in FIG. 3, for example), as will be described later. After the inserting process (M2), a body portion of the cylindrical housing is reduced to provide a predetermined outer diameter according to a preliminary shrinking process (M3*a*), or the honeycomb member is supported in the cylindrical housing on a longitudinal axial axis thereof according to an axially holding process (M3*b*).

Then, a necking process (M4) is performed to form a necking portion on at least one end portion of the cylindrical housing, with the body portion thereof being clamped. In this case, as the body portion of the cylindrical housing is formed to provide the predetermined outer diameter, it is clamped surely by means of a clamp device as described later. Thereafter, a sizing process (M5) is performed to reduce the diameter of at least a part of the cylindrical housing receiving therein the shock absorbent mat, down to such an appropriate inner diameter of the cylindrical housing as to cause the shock absorbent member to produce a desired holding pressure, thereby to produce a fluid treatment device P having a honeycomb member (e.g., catalytic converter). In this case, the clamping force (holding force) required for the necking process is provided not to cause a plastic deformation by the shrinking (reducing the diameter) operation. According to the shrinking operation made later in the sizing process (M5), however, a larger force than the clamping force required for the necking process (M4) will be applied to the cylindrical housing, thereby to be plastically deformed. It may be so constituted that both of clamping and sizing operations can be achieved by means of a clamp device capable of applying the forces required for both of the necking process and the sizing process.

Furthermore, in the sizing process (M5), it may be so constituted that, monitoring an axial load applied to the honeycomb member so as to move it along the longitudinal axis of the cylindrical housing by a predetermined axial distance, a most appropriate inner diameter of the cylindrical housing to be reduced in diameter after the necking process, is provided on the basis of a relationship between the axial load and the inner diameter of the cylindrical housing, as will be described later with reference to FIGS. 15–18.

Next, as an embodiment of the method for producing the fluid treatment device having the honeycomb member as described above, a method for producing a catalytic converter for use in an automotive vehicle will be explained with reference to FIGS. 2 and 3. The fluid treatment devices to be produced according to the present invention include the diesel particulate filter (DPF) as described before, and a reformer for use in a fuel cell. At the outset, in the same manner as shown in the assembling process (M0), a shock absorbent mat AM, which serves as the shock absorbent member of the present invention, is wrapped around a catalyst substrate CA as shown in FIG. 3, and fixed by an inflammable tape if necessary, to produce an assembled unit UT. In this respect, it is preferable to a use a conventional wrapping manner by forming in advance an extension and a recess (not shown) on the opposite ends of the shock absorbent mat AM, respectively, and wrapping the shock absorbent mat AM around the catalyst substrate CA, with the extension and recess engaged with each other.

According to the present embodiment, the catalyst substrate CA is a ceramic honeycomb member with a honeycomb structure having thin walls formed between neighboring cells (passages) which are more fragile than the prior products. However, the catalyst substrate CA may be made of metal, i.e., its material and method for producing it are not limited herein. The shock absorbent mat AM is constituted by an alumina mat which will be hardly expanded by heat, in this embodiment, but may be employed a vermiculite mat having a thermal expansion property, or a combination of those mats. Also, may be employed an inorganic fiber mat without binder impregnated. As the pressure is varied depending upon the shock absorbent mat with or without the binder impregnated, and its impregnated amount, it is required to take those into consideration when the pressure is determined. Or, as for the shock absorbent mat, a wire-mesh with thin steal wires meshed, or the like may be used, and it may be combined with a ceramic mat. In addition, those may be used in combination with an annular metallic retainer, a seal ring made of wire mesh, or the like. Furthermore, a shock absorbent mat formed in a cylindrical shape may be used, so that by simply inserting the catalyst substrate CA into the cylindrical mat, the shock absorbent mat comes to be placed in its mounted state around the catalyst substrate CA.

The cylindrical member as shown at the left side in FIG. 3 is called as outer cylinder, housing or casing. With respect to the catalytic converter, the honeycomb member corresponds to a catalyst substrate, e.g., the substrate of a honeycomb structure, and the shock absorbent member corresponds to a shock absorbent mat for holding the substrate. With respect to the DPF, the honeycomb member corresponds to a filter, and the shock absorbent member corresponds to a shock absorbent mat for holding the filter. In general, the substrate or filter corresponding to the honeycomb member is formed into a column with a circular cross section or a cylinder. According to the present invention, however, the substrate includes the one with a noncircular cross section, such as an elliptic cross section, oval cross section, cross section having a plurality of radiuses of curvature, polygonal cross section, and the like. The cross section of each passage (cell) of the catalyst substrate or the filter of DPF is not limited to a hexagon, but may be selected from other shapes such as a square or the like.

Figure 2:
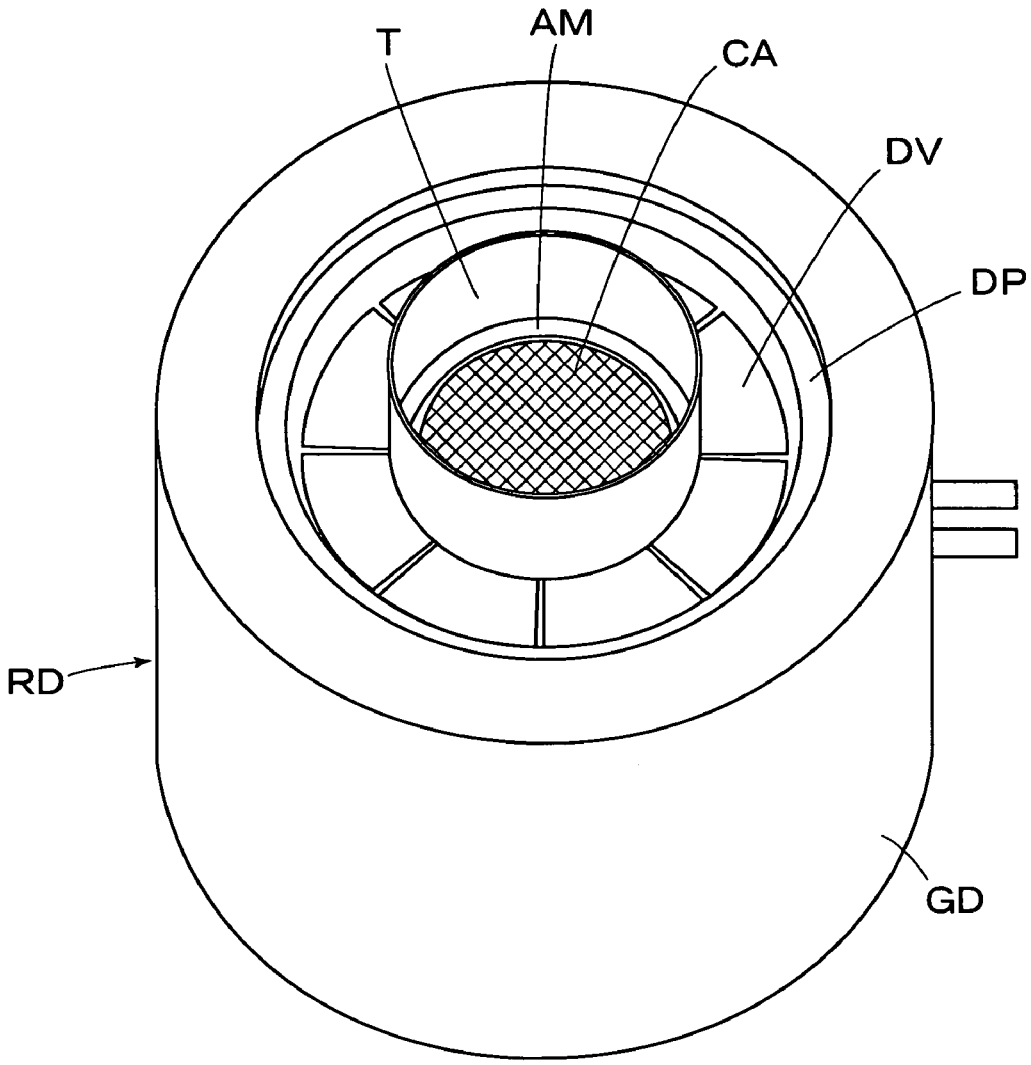
FIG. 2 is a perspective view showing an embodiment of a shrinking device for use in the method according to an embodiment of the present invention.
Figure 3:
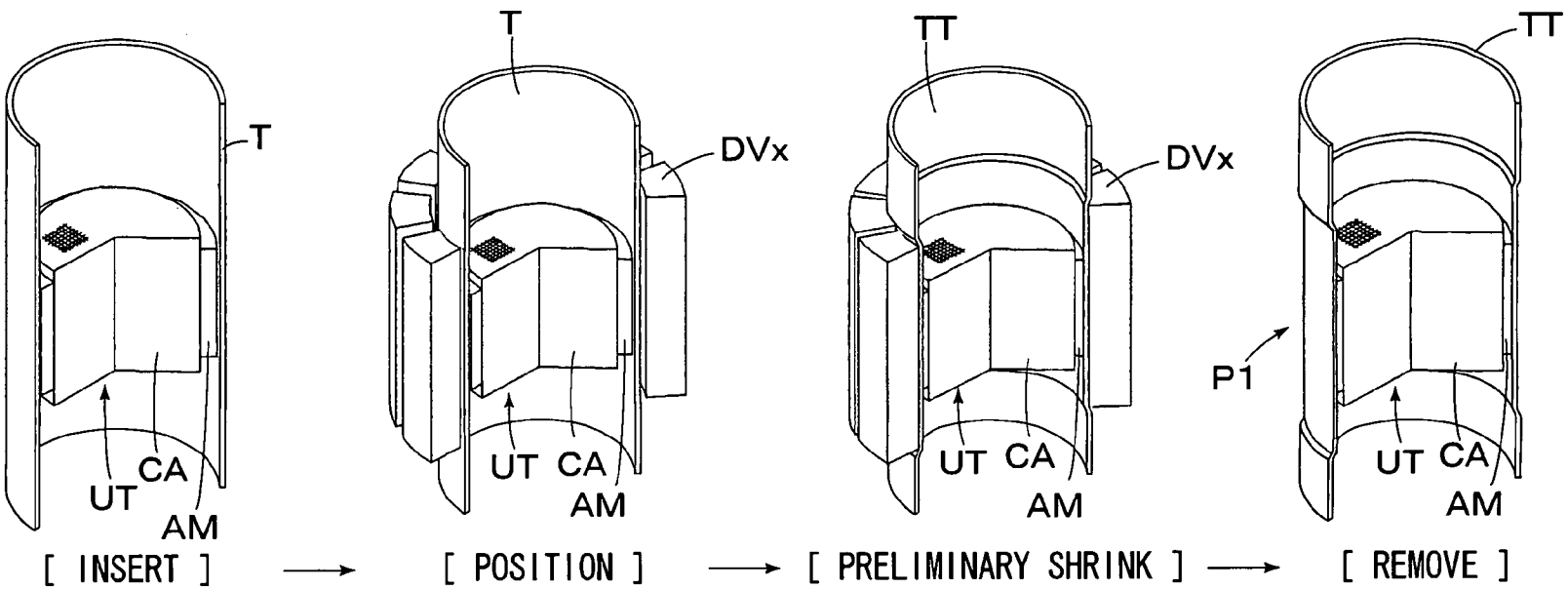
FIG. 3 is a perspective view showing a preliminary shrinking process in the method according to an embodiment of the present invention.

FIG. 2 illustrates an embodiment of the shrinking device RD for use in the preliminary shrinking process (M3*a*) and sizing process (M5) served as the last shrinking process as disclosed in FIG. 1, using the chucks of split dies type (finger type). As shown in FIG. 2, a cylindrical pushing die DP having a tapered inner surface is accommodated fluid-tightly and slidably in a housing GD. Furthermore, a plurality of compressing members DVx are accommodated in the cylindrical pushing die DP, to function at least as the compressing members for use in the shrinking process. Each compressing member DVx has a tapered outer surface, to be slidably fitted into a tapered inner surface of the pushing die DP. The pushing die DP and compressing members DVx are actuated by a hydraulic pressure actuating device (not shown), so that the pushing die DP is moved along the axis (longitudinal direction) of the housing GD by the hydraulic pressure, and the compressing members DVx are moved radially (toward the central axis) in response to movement of the pushing die DP. In either shrinking device, eight dies have been provided, but the number of dies is not limited to it. It may be larger or smaller than eight, and may be of odd or even number. Any method for moving the dies may be used. Although it is desirable to control as many dies as possible individually, the number of dies may be determined in view of the required accuracy, feasibility, cost or the like. An apparatus of so-called collet type may be employed. The hydraulic pressure actuating device (not shown) is controlled by a controller (not shown) as will be described later.

FIG. 3 illustrates a practical embodiment of the preliminary shrinking process (M3*a*) in FIG. 1, as well as the sizing process (M5) in FIG. 1. At the outset, the assembled unit UT with the shock absorbent mat AM wrapped around the catalyst substrate CA is inserted into the cylindrical housing T loosely (Inserting process). Next, the assembled unit UT and the cylindrical housing T are inserted into a cylinder formed with a plurality of compressing members (DVx) to be placed at a predetermined position (Positioning process). Then, the diameter of the cylindrical housing T is reduced together with the shock absorbent mat AM by the compressing members DVx, to such an extent that the outer diameter of the part of a cylindrical housing TT with the shock absorbent mat AM received therein substantially equals a predetermined diameter (Dt) (Preliminary shrinking process). As a result, when the assembled unit UT and the cylindrical housing T are removed from the compressing members DVx (Removing process), there is produced a primary intermediate workpiece P1 which holds the assembled unit UT with the shock absorbent mat AM wrapped around the catalyst substrate CA in the cylindrical housing TT. Then, the necking process (M4) as shown in FIG. 1 is made, as will be described later.

Figure 4:
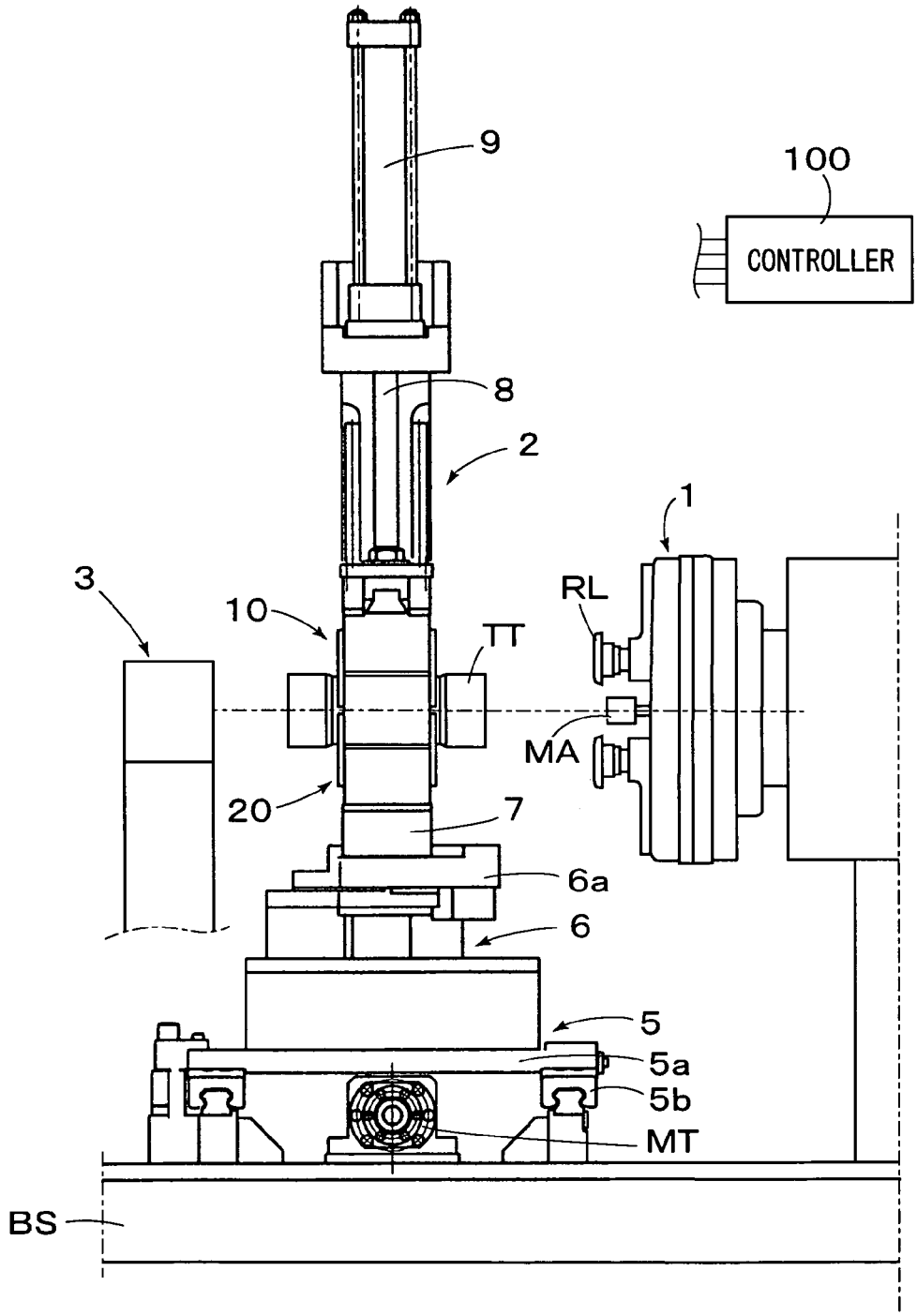
FIG. 4 is a front view showing a clamp device and a spinning apparatus for use in the method according to an embodiment of the present invention.

FIG. 4 illustrates an embodiment of an apparatus for use in the method according to the present invention, which is adapted to form opposite ends of the cylindrical housing TT for receiving therein the catalyst substrate CA with its body portion (intermediate portion) reduced in diameter as shown in FIG. 3, which is served as a primary intermediate workpiece P1, to provide the necking portions on the opposite ends of the cylindrical housing TT. As shown in FIG. 4, there are arranged on a base BS in parallel, a spinning apparatus 1 for performing a spinning process to an end portion of the cylindrical housing TT to be formed, a clamp device 2 for holding the body portion of the cylindrical housing TT, and a chuck device 3 arranged to face the other end of the cylindrical housing TT, for installing the cylindrical housing TT on the clamp device 2 and removing the former from the latter. According to the apparatus as shown in FIG. 4, therefore, with a controller 100 controlled, the clamp device 2 is actuated to move relative to the spinning apparatus 1, and the end portion of the cylindrical housing TT is formed by the spinning apparatus 1, so as to provide the necking portion which is offset to, oblique to, or skewed from the body portion of the cylindrical housing TT. The spinning apparatus 1 according to the present embodiment can be moved along X-axis (horizontal axis in FIG. 4), with three rollers RL being actuated to form the necking portion on the end portion of the cylindrical housing TT. The structure of spinning apparatus 1 is substantially the same as the one as disclosed in the aforementioned Japanese Publication No.2001-25826, so that detailed explanation of which is omitted herein. Furthermore, a mandrel MA that is formed to match with the inner shape of the open end of cylindrical housing TT, is provided on the same axis as the main shaft of the spinning apparatus 1 as indicated by one-dot chain line in FIG. 4.

Figure 5:
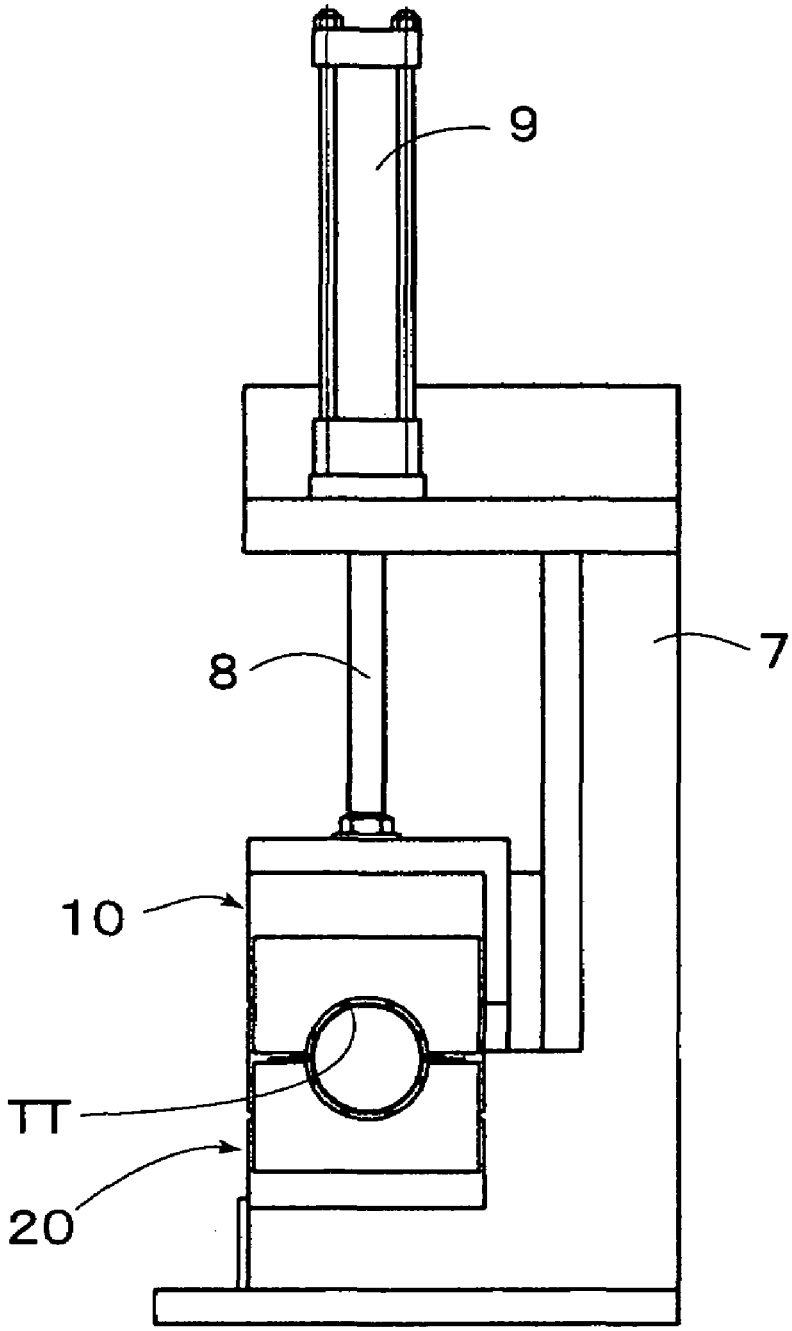
FIG. 5 is a side view showing a clamp device in its clamped state for use in the method according to an embodiment of the present invention.

As shown in FIG. 4, a horizontally driving device 5 and a rotating device 6 are arranged on the base BS, and the clamp device 2 is fixed on the rotating device 6. As shown in FIG. 5, the clamp device 2 is provided with an upper clamp member 10 and lower clamp member 20 for moving close to or remote from each other, and holding the body portion of the cylindrical housing TT by moving them close to each other. The clamp members 10 and 20 are supported to be moved by the horizontally driving device 5 on the surface parallel to the axis of the cylindrical housing TT, and to be rotated by the rotating device 6 around the axis vertical to the axis of the cylindrical housing TT. With respect to the horizontally driving device 5, a table 5*a* is arranged to be movable along a pair of Y-axis guide rails 5*b* secured to the base BS (perpendicularly to the X-axis). The table 5*a* has a ball socket (not shown) which is secured under the table 5*a*, and which is meshed with a spline shaft (not shown). This shaft is mounted on the base BS in parallel with the Y-axis guide rails 5*b*, to be rotated by a servo motor MT. Accordingly, when the spline shaft is rotated by the servo motor MT, the table 5*a* is moved along the Y-axis.

The rotating device 6 is placed on the table 5*a*, to be capable of rotating a table 6*a* about an axis vertical to the base BS, i.e., Z-axis. On the table 6*a*, fixed is a C-shaped frame 7 having two members as shown in FIG. 5, on the upper member of which the upper clamp member 10 is supported to be moved vertically, and on the lower clamp member 20 of which the lower clamp member 20 is fixed. The upper clamp member 10 is supported on the upper member of the frame 7 through a rod 8. The upper clamp member 10 and lower clamp member 20 are arranged to clamp the cylindrical housing TT between them, and inner diameters of their cylindrical clamping surfaces are set to be the same as the outer diameter of the body portion of the cylindrical housing TT, so that their cylindrical clamping surfaces match with the outer peripheral surface of the cylindrical housing TT, thereby to maintain substantially surface contacting state with it.

On the upper member of the frame 7, an actuator 9 activated by oil pressure for example, is fixed to drive the upper clamp member 10 vertically through a rod 8. When the cylindrical housing TT is set on or removed from the clamp device 2, the upper clamp member 10 is lifted by the actuator 9 upward. The chuck device 3 is arranged opposite to the spinning apparatus 1 through the clamp device 2, and supported by the horizontally driving device 5 to be movable toward and away from the clamp device 2, together with the horizontally driving device 5. The horizontally driving device 5, rotating device 6, actuator 9 of the clamp device 2, and driving mechanisms (not shown) of the spinning apparatus 1 and chuck device 3 are controlled by the controller 100.

As described above, the cylindrical housing TT is held surely in such a state that its axis matches with the main shaft (working central axis) of the spinning apparatus 1, and the inner diameter of the cylindrical housing TT matches with the outer diameter of the body portion (portion applied with the preliminary shrinking process) of the cylindrical housing TT. Therefore, in the case where the spinning process is performed to provide the necking portion having such a relationship with the body portion of the cylindrical housing TT as being at least one of offset to, oblique to, or skewed from the body portion, a sufficient clamping force (holding force) can be obtained for the spinning process.

Figure 6:
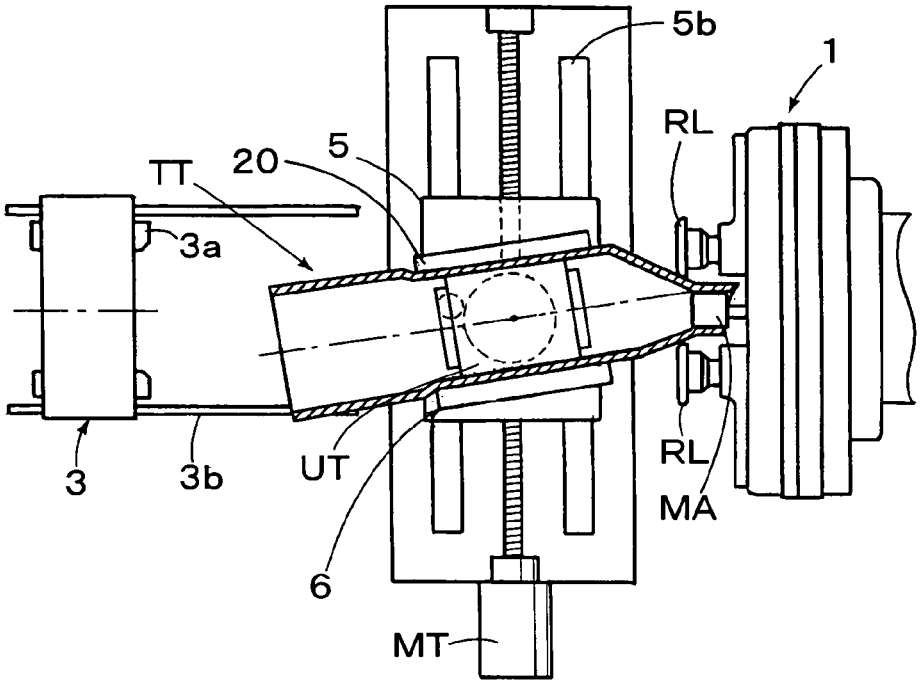
FIG. 6 is a plan view showing a necking process by means of spinning rollers, together with a chuck device, in the method according to an embodiment of the present invention.

According to the present embodiment, the chuck device 3 is the same as the one as disclosed in the Japanese Publication No.2001-25826, and provided with a pair of chucks 3*a*, which are movable in a radial direction toward the axis aligned with the central axis of the main shaft, and which are capable of holding the cylindrical housing TT as shown in FIG. 6, to rotate the cylindrical housing TT about the central axis for indexing it. The chuck device 3 is arranged to be movable toward and away from the clamp device 2 along rails 3*b* arranged in parallel with the main shaft of the spinning apparatus 1 by means of an electric motor (not shown), which is actuated by the controller 100 during the spinning process.

Figure 7:
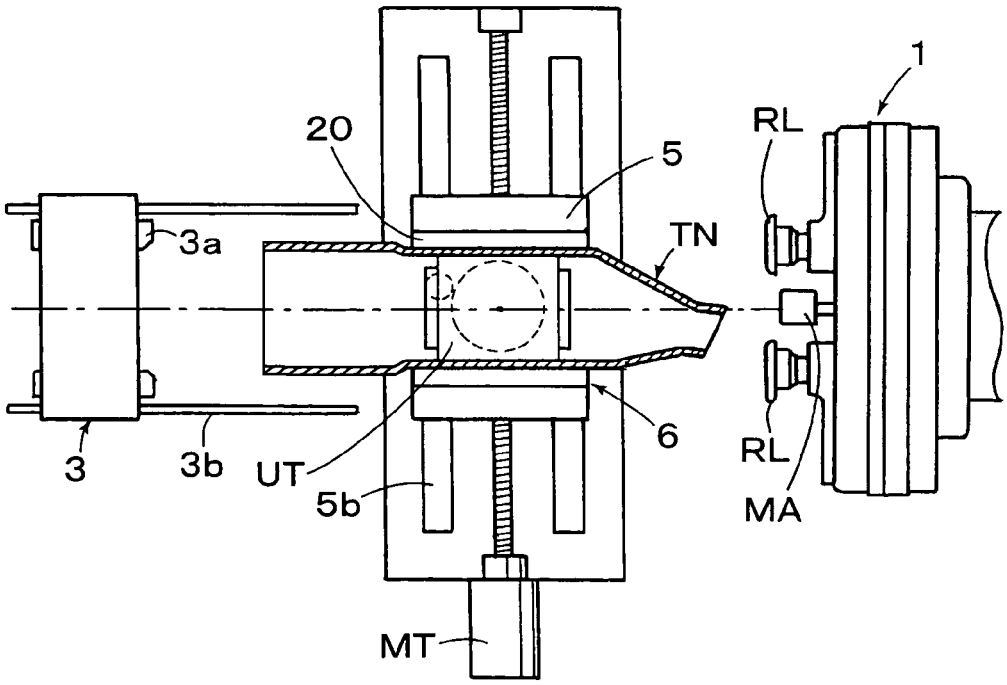
FIG. 7 is a plan view showing a necking process by means of spinning rollers, together with a chuck device, in the method according to an embodiment of the present invention.

FIG. 6 shows such a state that after the spinning process was performed with respect to one end portion of the cylindrical housing TT to provide a cylindrical housing TN formed with a necking portion with its axis oblique to the body portion (intermediate portion), the chucks 3*a* were moved outward to release the cylindrical housing TN from being held by the chucks 3*a*, and then the chuck device 3 was retracted along the rails 3*b*. In this state, the clamp device 2 is rotated by the rotating device 6, and the cylindrical housing TN is returned to its initial position on the axis aligned with the central axis of the cylindrical housing TN as shown in FIG. 7. Then, the rollers RL are retracted to their initial positions placed at the right side in FIG. 7. Thereafter, the upper clamp member 10 of the clamp device 2 is lifted upward so that the cylindrical housing TN is placed in its unclamped state.

Figure 8:
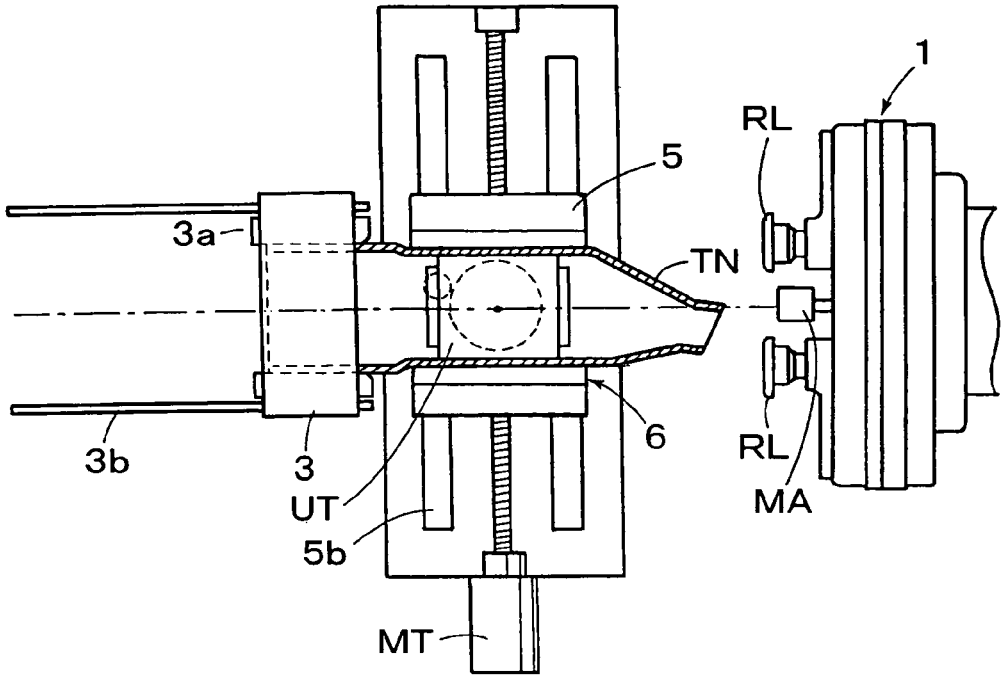
FIG. 8 is a plan view showing a necking process by means of spinning rollers, together with a chuck device, in the method according to an embodiment of the present invention.

Then, as shown in FIG. 8, the chuck device 3 is moved forward along the rails 3*b*, and the other end portion of the cylindrical housing TN is held by the chucks 3*a*. And, the chuck device 3 is rotated together with the cylindrical housing TN about the central axis thereof, to perform the indexing. That is, when the cylindrical housing TN is rotated by a predetermined rotational angle, the upper clamp member 10 is lowered, so that the cylindrical housing TN is clamped between the upper clamp member 10 and the lower clamp member 20. Then, the chuck device 3 is retracted leftward in FIG. 8. In the case where the both ends of the cylindrical housing TN are to be formed on the same plane, the indexing will not be performed, but only the reversing operation will be performed.

Figure 9:
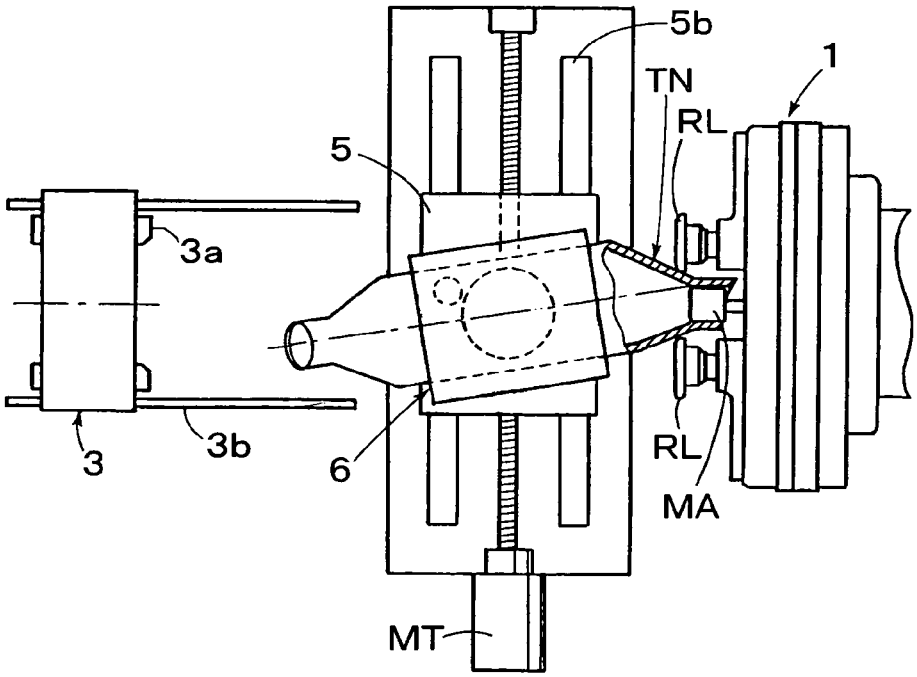
FIG. 9 is a plan view showing a necking process by means of spinning rollers, together with a chuck device, in the method according to an embodiment of the present invention.

In the state as described above, when the clamp device 2 with the cylindrical housing TN clamped thereby is rotated about the vertical axis (perpendicular to the plane in FIG. 8) by 180 degree, the cylindrical housing TN is reversed as shown in FIG. 9. In this case, trimming may be made to the end portion with the spinning process finished, if necessary, by a cutting device (not shown) mounted on the spinning apparatus or arranged adjacent to the spinning apparatus, thereby to form an open end face (not shown) perpendicular to the central axis. Then, the spinning process is performed with respect to the other end portion (right side in FIG. 9) of the cylindrical housing TN, thereby to form the necking portion whose axis is oblique to the axis of the body portion. Thereafter, the cylindrical housing TN is released from being held by the clamp device 2, so that a finished secondary intermediate workpiece (not shown) is removed from the apparatus.

According to the present embodiment, therefore, the necking process can be performed for both end portions of the cylindrical housing TT consecutively in a single spinning process, so that the working time can be shortened largely, comparing with the prior individual process applied to each end portion. Furthermore, if the chuck device 3 is so constituted that it can be rotated or moved together with the cylindrical housing TT, the indexing can be made without its returning operation to the initial position (FIG. 7) being performed, so that the working time can be shortened further. If the clamp device 2 is provided with an indexing mechanism such as the chuck device 3, the chuck device 3 will not have to be provided, so that the apparatus can be simplified and the working time can be shortened further.

In the embodiment as described above, the spinning apparatus 1 is moved along the X-axis, and the cylindrical housing TT is moved along the Y-axis, so that they are moved on the horizontal surface relative to each other. Whereas, it may be so constituted that the spinning apparatus 1 is fixed to the base BS, while the cylindrical housing TT is moved along the X-axis and Y-axis. The height of the central axis of the cylindrical housing TT to the base BS may be adapted to be variable, and the central axis may be adjusted vertically relative to the main shaft of the spinning apparatus 1. Furthermore, it is possible to enlarge an end portion of the cylindrical housing TT by applying the rollers RL to the inner surface of the cylindrical housing during the spinning process TT, thereby to form an enlarged portion (not shown), whose axis may be formed into not only the common axis to the body portion, but also such an axis as at least one of offset from, oblique to and skewed from the axis of the body portion. Then, the part of the cylindrical housing TT receiving therein at least the shock absorbent mat AM is reduced in diameter by the shrinking device RD as shown in FIG. 2, for example, to be reduced in diameter together with the shock absorbent mat AM to such an extent that an appropriate inner diameter of the cylindrical housing TT will be provided to produce a desired holding pressure by the shock absorbent mat AM.

Figure 10:
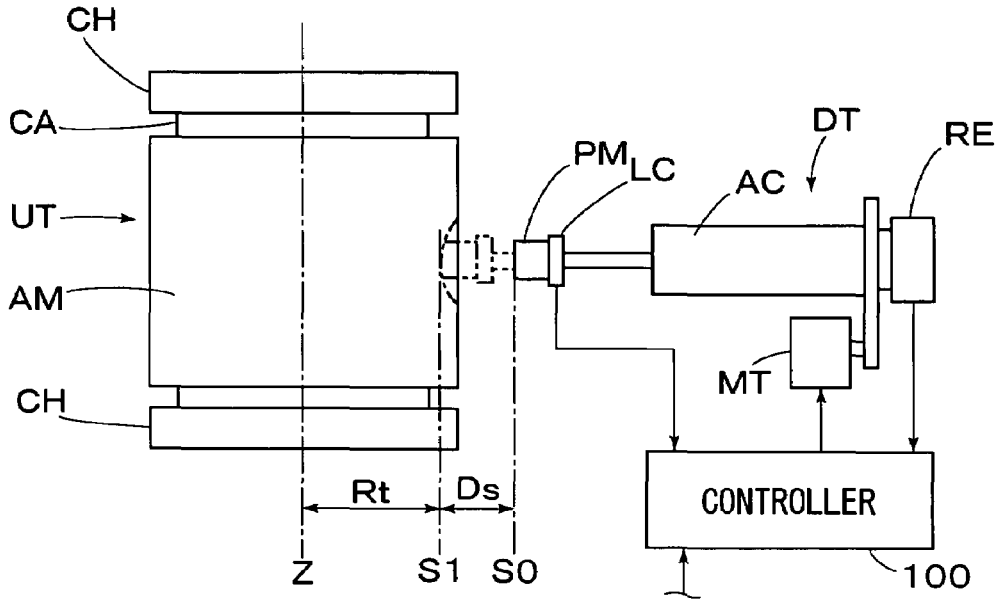
FIG. 10 is a front view showing a measurement process in the method according to an embodiment of the present invention.
Figure 13:
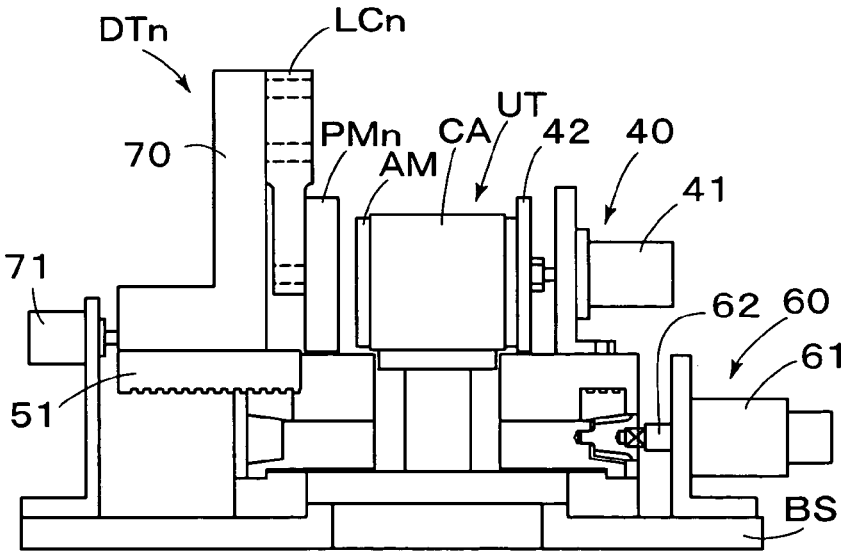
FIG. 13 is a front view showing an example of a multipoint measuring device for use in the method according to an embodiment of the present invention.
Figure 14:
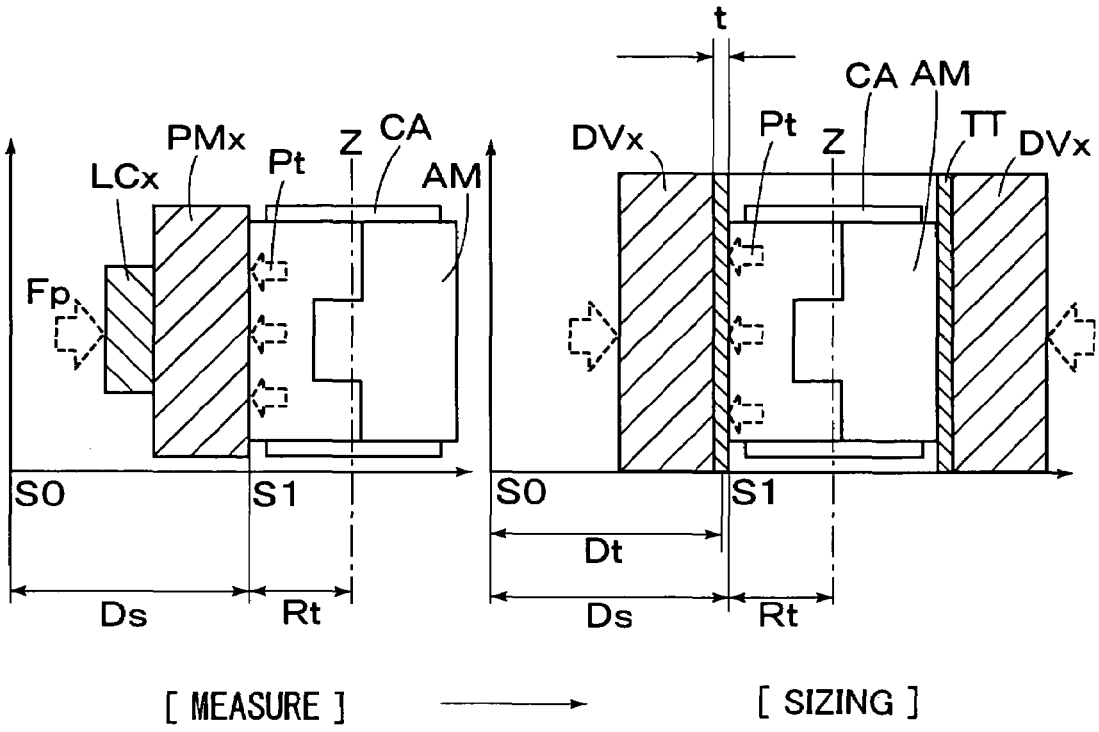
FIG. 14 is a diagram for explaining a measurement process and a sizing process in the method according to an embodiment of the present invention.

Next, referring to FIGS. 10–13, will be explained the measurement process of the present embodiment corresponding to the measurement process (M1) in FIG. 1, with reference to FIG. 14 showing the relationship between the measurement process (M1) and sizing process (M5) in FIG. 1. As shown in FIG. 10, the assembled unit UT as described above is clamped between a couple of clamp devices CH, and the catalyst substrate CA is compressed by the pushing member PM of the measuring device DT through the shock absorbent mat AM, in a radial direction toward the longitudinal axis of the catalyst substrate CA. Then, the pressure applied to the catalyst substrate CA is measured, and a distance between the axis Z of the catalyst substrate CA and an end of the pushing member PM when the measured pressure (Ps) substantially equals a predetermined target pressure (Pt) is measured, to provide a target radius (Rt). After measuring it, the pushing member PM is returned to its initial position, and then the clamping state by the clamp device CH is released. The measuring device DT of the present embodiment includes an actuator AC with a ball screw driven by a motor MT, the pushing member PM mounted on its front end with a load cell LC disposed for detecting the pressure, and a rotary encoder RE disposed at the rear end of the actuator AC for detecting the position. Signals detected by the load cell LC and rotary encoder RE are input to an electronic control device (hereinafter called as controller 100), and converted into various data as described later to be memorized in a memory (not shown). The motor (MT) is controlled by the controller 100.

The pushing member PM is arranged to move back and forth in the direction perpendicular to the axis Z of the catalyst substrate CA (leftward and rightward in FIG. 10), and contact the shock absorbent mat AM to compress it. As the contacting area of the pushing member PM is known, the reaction force caused when the catalyst substrate CA and shock absorbent mat AM to be measured are pressed by the pushing member PM is detected by the load cell LC to provide the pressure applied to the catalyst substrate CA, which is input to the controller 100. In the controller 100, the signal detected by the load cell LC is converted into the pressure to be memorized into the memory, and compared with the predetermined target pressure (Pt) which was input into the controller 100 in advance separately. Furthermore, the moving amount and stop position of the pushing member PM are detected by the rotary encoder RE as factors indicative of rotation of the ball screw (not shown), to be input into the controller 100. In the controller 100, the signal detected by the rotary encoder RE is converted into the moving amount and stop position of the pushing member PM to be memorized in the memory at real time. Those detecting means and the controller 100 may be connected electrically or optically.

The relationship between a distance from the axis Z of the catalyst substrate CA to the pushing member PM, and the pressure applied to the catalyst substrate CA can be identified, with the measuring device DT actuated as follows. That is, when the pushing member PM is advanced from its initial position (moved from "S0" point leftward in FIG. 10) to pressurize a part of the shock absorbent mat AM, and the reaction force at the pressurized portion of the shock absorbent mat AM has reached a predetermined value, a certain position ("S1" point in FIG. 10) is identified. This position ("S1" point in FIG. 10) corresponds to the position of the inner surface of the cylindrical housing T which is placed when the pressure of the shock absorbent mat AM of the finished product has become the target pressure (Pt) (i.e., after the shrinking process). Therefore, the relationship between the pushing force applied to the catalyst substrate CA and the reaction force (pressure) caused thereby is memorized in advance in the memory of the controller 100. On the basis of the relationship, the signal detected by the load cell LC is converted into the pressure, and with the pressure being compared with a predetermined value, the pushing member PM is advanced to the position ("S1" point in FIG. 10), thereby to detect the moving distance (Ds) of the pushing member PM.

Accordingly, by subtracting the moving distance (Ds) of the pushing member PM detected by the rotary encoder RE, from a predetermined distance between the end position ("S0" point in FIG. 10) of the pushing member PM and the axis Z of the catalyst substrate CA, the initial position of the pushing member PM, i.e., the position of the target radius (Rt) away from the axis Z can be determined. This position corresponds to the position of the inner surface of the cylindrical housing T which is placed when the pressure of the shock absorbent mat AM of the finished product is maintained at a predetermined pressure (i.e., after the shrinking process). According to the present embodiment, therefore, the position ("S1" point in FIG. 10) which becomes the predetermined pressure can be determined, without measuring the dimensions or properties of the catalyst substrate CA and shock absorbent mat AM individually, nor using a so-called GBD value (abbreviation of gap bulk density, i.e., density of the shock absorbent mat AM obtained from [weight per unit area/bulk gap]). That is, as the distance between the end position of the pushing member PM and the axis Z of the catalyst substrate CA result in the value taken into consideration not only the error in the outer diameter of the catalyst substrate CA, but also the error in weight per unit area. Therefore, those errors are not required to be measured or evaluated separately, at all.

The distance (Ds) and target radius (Rt) are memorized in the memory of the controller 100 for the next process, and may be indicated if necessary. A plurality of measuring devices DT may be disposed radially about the axis Z of the catalyst substrate CA to achieve the multipoint measurement, or the clamp device CH and the assembled unit UT may be rotated (indexed) about the axis Z to achieve the multipoint measurement, and then to obtain the mean value of the measured values. Particularly, in the case where the catalyst substrate CA is not formed in a circular cross section, it is required to achieve the multipoint measurement dependent upon the shape of the catalyst substrate CA, so that it is desirable to place a plurality of measuring devices DT. The pushing member PM is not necessarily required to be stopped at the predetermined position ("S1" point in FIG. 10), but may be retracted after the position was determined, and further, the clamped state by the clamp device CH may be released in synchronously with the retracting motion of the pushing member PM. In the case where the accuracy of force required for holding the catalyst substrate CA may be of a level capable of neglecting error of the shock absorbent mat AM, such a simple measurement process as measuring a diameter or cross sectional area of only the catalyst substrate CA may be employed, instead of the aforementioned measurement process.

Figure 11:
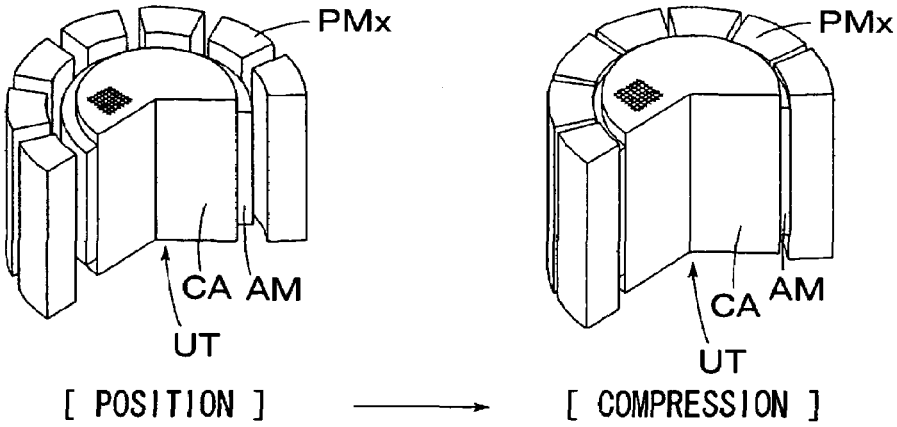
FIG. 11 is a perspective view showing another measurement process in the method according to an embodiment of the present invention.
Figure 12:
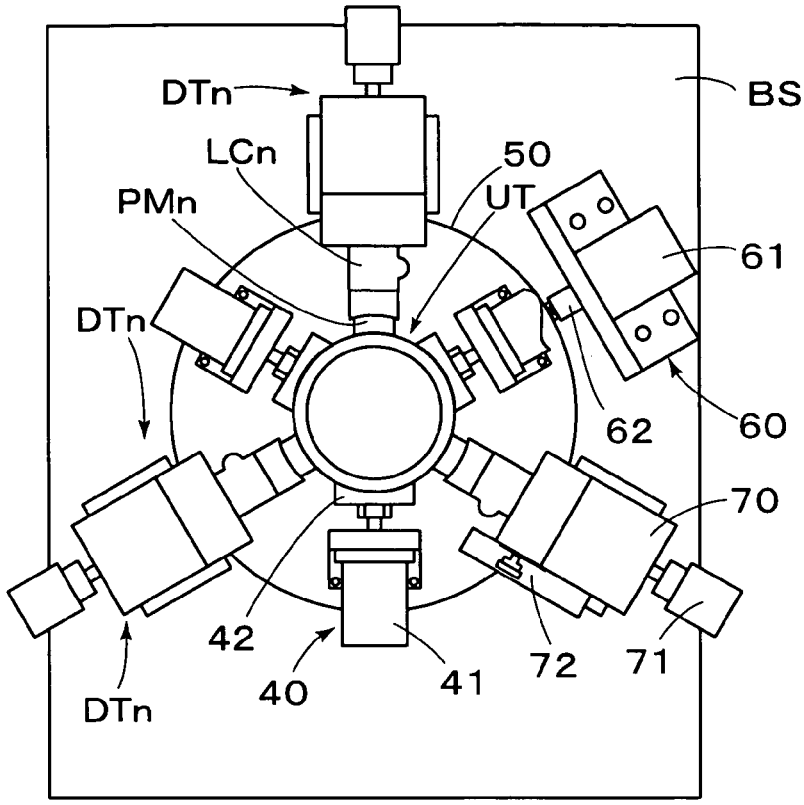
FIG. 12 is a plan view showing an example of a multipoint measuring device for use in the method according to an embodiment of the present invention.

With respect to the aforementioned measurement process (same as the measurement process (M1) in FIG. 1), as shown in FIG. 12, a plurality of pushing members PMx may be positioned radially about the axis Z of the catalyst substrate CA, and the shock absorbent mat AM may be compressed by a plurality of measuring devices DTn including those pushing members PMx to achieve the multipoint measurement, or the clamp device CH and the assembled unit UT may be rotated (indexed) about the axis Z to achieve the multipoint measurement, and then to obtain the mean value of the measured values. The same is true of the measurement process (M1) as shown in FIG. 1. Particularly, in the case where the catalyst substrate CA is not formed in a circular cross section, it is required to achieve the multipoint measurement dependent upon the shape of the catalyst substrate CA, so that it is desirable to place a plurality of measuring devices DTn. As shown in FIG. 11, the plurality of pushing members PMx comprise elongated members each of which is longer than at least the longitudinal length of the shock absorbent mat AM, and are placed in parallel with one another along the entire periphery of the shock absorbent mat AM, with approximately no clearance between them. The multipoint measurement may be performed by some of them, as will described hereinafter an embodiment capable of performing the multiple measurement, with reference to FIGS. 12 and 13.

FIGS. 12 and 13 illustrate an embodiment of the multipoint measuring device, wherein a so-called scroll chuck 50 and an actuating device 60 for actuating it are placed on a horizontal base BS. The scroll chuck 50 has three chucks 51 which are placed at three positions evenly spaced around the center, and which are radially movable simultaneously. The chucks 51 are adapted to be moved radially toward or away from the center of them by the same amount respectively, in response to the rotation of a shaft 62, which is rotated by a motor 61 of the actuating device 60. In other words, the three chucks 51 are moved close to or away from each other, or fixed by the actuating device 60. On each chuck 51, L-shaped holder 70 is mounted to serve as each measuring device DTn, which includes an load cell LCn mounted on each L-shaped holder 70, and an elongated pushing member PMn fixed to the load cell LCn. In order to prevent each chuck 51 from being vibrated due to back-lash of the scroll chuck 50, each holder 70 is biased toward the center or in the radial direction, by means of an pneumatic cylinder 71 mounted on the base BS.

In case of measurement, the three chucks 51 and the holder 70 fixed thereto are moved toward the center by the same amount respectively, by means of the actuating device 60, so that each pushing member PMn contacts the shock absorbent mat AM wrapped around the catalyst substrate CA, simultaneously. When each pushing member PMn further moves toward the catalyst substrate CA, the shock absorbent mat AM will be compressed in the radial direction (perpendicularly to the axis of the catalyst substrate CA). The compression reaction force of the shock absorbent mat AM exerted on each pushed portion thereof is detected by each load cell LCn, and determined is a position where the detected result has reached a predetermined value, and which position corresponds to the position S1 away from the central axis Z by the distance Rt as shown in FIG. 10. Then, the distance between the each pushing member PMn reached that position and the axis of the catalyst substrate CA is measured, to obtain the mean value. In this respect, as the end of each pushing member PMn can be identified on the basis of the number of rotation of the motor 61, the distance between each pushing member (PMn) and the axis of the catalyst substrate CA can be obtained. Or, as shown in FIG. 12, by means of a position measuring device 72 using a digital length measuring system, e.g., "magnescale" of Sony Precision Technology Inc., the moving amount of the holder 70 or the like can be measured directly. According to the present embodiment, therefore, the moving distance of each pushing member (PMn) is measured directly by the position measuring device 72.

Furthermore, three holding devices 40 are mounted on the scroll chuck 50 to be evenly spaced between each measuring device DTn. The holding devices 40 are provided with pneumatic cylinders 41 biasing holding members 42 in the radial direction toward or away from the center, for positioning (centering) the assembled unit UT of the catalyst substrate CA and shock absorbent mat AM, and assisting to hold it during the measurement process. Accordingly, in advance of the measurement process, each holding devices 40 is moved toward the center to position the assembled unit UT, and hold it, with a little force applied toward the center. In this holding state, a consecutive measurement process by the measuring device DTn is achieved. After the measurement is finished, the holding member 42 is actuated by the pneumatic cylinder 41 in the radial direction away from the shock absorbent mat AM to return to its initial position.

On the basis of the result measured in the measurement process as described above, the aforementioned sizing process (corresponding to the process M5) is performed. The relationship between these processes will be explained hereinafter, with reference to FIG. 14. The measurement process of this embodiment is basically the same as the measurement process shown in FIG. 10, as shown at the left side in FIG. 14, which shows a part of the multipoint measuring device with a plurality of pushing members PMx disposed around the axis Z of the catalyst substrate CA as shown in FIG. 11. According to this method, the pushing member PMx is advanced from its initial position (rightward from "S0" point in FIG. 14) to pressurize the shock absorbent mat AM, with the pressurizing force Fp applied thereto, along the entire longitudinal length of the shock absorbent mat AM. Then, by detecting a certain position ("S1" point in FIG. 14) when the pressure at the pressurized portion (the reaction force of the shock absorbent mat AM) obtained on the basis of the detected value of the load cell LCx has reached the target pressure (Pt), the position with the target radius (Rt) away from the axis (Z) of the catalyst substrate CA can be determined.

In the sizing process applied to the cylindrical housing TT with the preliminary shrinking process finished, therefore, if the diameter of the cylindrical housing T is reduced, with the shock absorbent mat AM being compressed, to such an extent that the inner radius of the part of the cylindrical housing T for enclosing the shock absorbent mat AM substantially equals the target radius (Rt), the catalyst substrate CA is held in the cylindrical housing T to be compressed at the target pressure (Pt). In this case, the diameter of the cylindrical housing TT is reduced, with the shock absorbent mat AM being compressed, by means of a plurality of compressing members DVx, instead of which the pushing members PMx for the measurement process may be used also for the sizing process, as follows. Based upon the moving distance (Ds) from the initial position ("S0" point) of the pushing members PMx in the measurement process, if the compressing members DVx are moved by the distance (Ds-t) which is the result of subtracting the thickness (t) of the cylindrical housing TT from the moving distance (Ds), the inner radius of the part of the cylindrical housing TT will become substantially equal to the target radius (Rt). If it is so constituted that the pushing members PMx used for the measurement process and the compressing members DVx used for the sizing process are made by common members and can be compressed by a common compressing device, the measurement process and the sizing process can be achieved by a single device.

Figure 20:
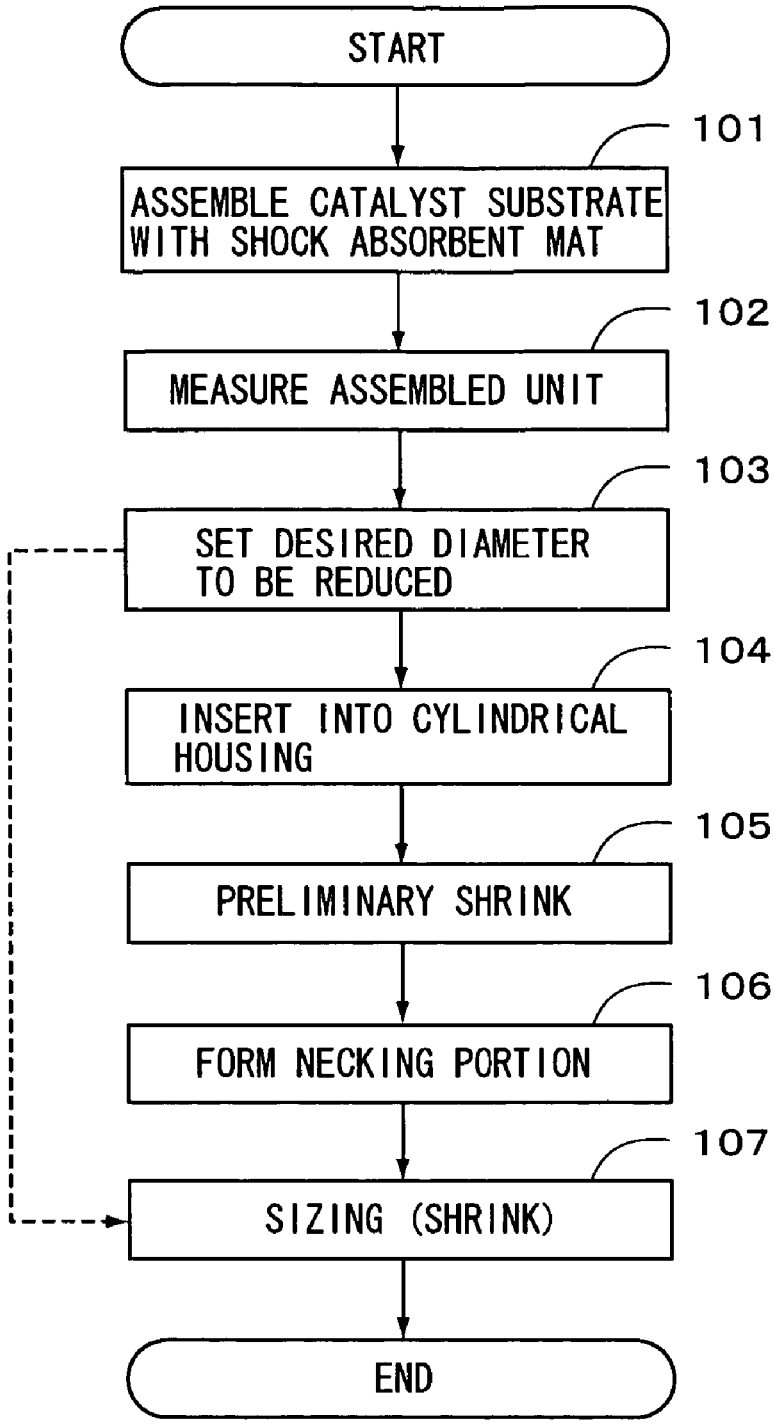
FIG. 20 is a flowchart showing an example of the method according to an embodiment of the present invention.

Referring next to FIG. 20, a method for producing a product will be explained in accordance with processes made in sequence, as a practical embodiment of the method for producing the catalytic converter by means of the devices as described above. At the outset, after the shock absorbent mat AM with its density of 1400 g/m$^2$±10% was assembled with (wrapped around) the outer surface of the catalytic substrate CA with its outer diameter of 103 mm ±1.0 mm at Step 101, the assembled unit is measured at Step 102 as described above. Then, set at Step 103 and stored in the controller 100 is a desired diameter to be reduced to provide an outer diameter (e.g., 114.0 mm) of the cylindrical housing TT reduced in diameter together with the shock absorbent mat AM to produce a desired holding pressure by the shock absorbent mat AM. Then, the program proceeds to Step 104 where the catalyst substrate CA with the shock absorbent mat AM wrapped around it is inserted into the cylindrical housing T with its outer diameter of 124 mm ±0.4 mm, and proceeds to Step 105 where the preliminary shrinking process (corresponding to the process M3*a* in FIG. 1) is performed until the outer diameter comes to be a predetermined outer diameter (e.g., 117.8 mm), which is of an appropriate constant value for the clamp device to hold the cylindrical housing T. In other words, the holding force is given priority when setting the constant value, enough to hold the catalyst substrate CA in the cylindrical housing T not to be moved in the next step for the necking process by means of spinning or the like, and therefore it is not required at this stage to produce an ultimate pressure to be applied to the cylindrical housing T.

Next, the program proceeds to Step 106 where the necking portions are formed at opposite sides of the cylindrical housing TT to produce a cylindrical housing TN, and further proceeds to Step 107 where the sizing process is achieved as described before, to reduce the diameter of the body portion (intermediate portion) of the cylindrical housing TN for receiving therein the catalyst substrate CA and the absorbent mat AM, until the outer diameter of the body portion will come to be the outer diameter (e.g., 114.0 mm) set at Step 103. Consequently, the catalyst substrate CA is held in the cylindrical housing TN with the shock absorbent mat AM producing the appropriate pressure applied to the catalyst substrate CA.

In combination of the catalyst substrate CA and the shock absorbent mat AM, therefore, it is possible to clamp the cylindrical housing T always in a constant clamping state, without being influenced by the clamp in the necking process to be performed after the sizing process, even if the outer diameter of the part of the cylindrical housing T to be sized varies. The necking process may be applied only to one end portion of the cylindrical housing. Instead of employing the spinning apparatus, a separate member formed in a cone shape, for example, may be welded to the cylindrical housing. As for the sizing process, may be employed the spinning process as disclosed in the Japanese Publication No.2001-107725.

Figure 15:
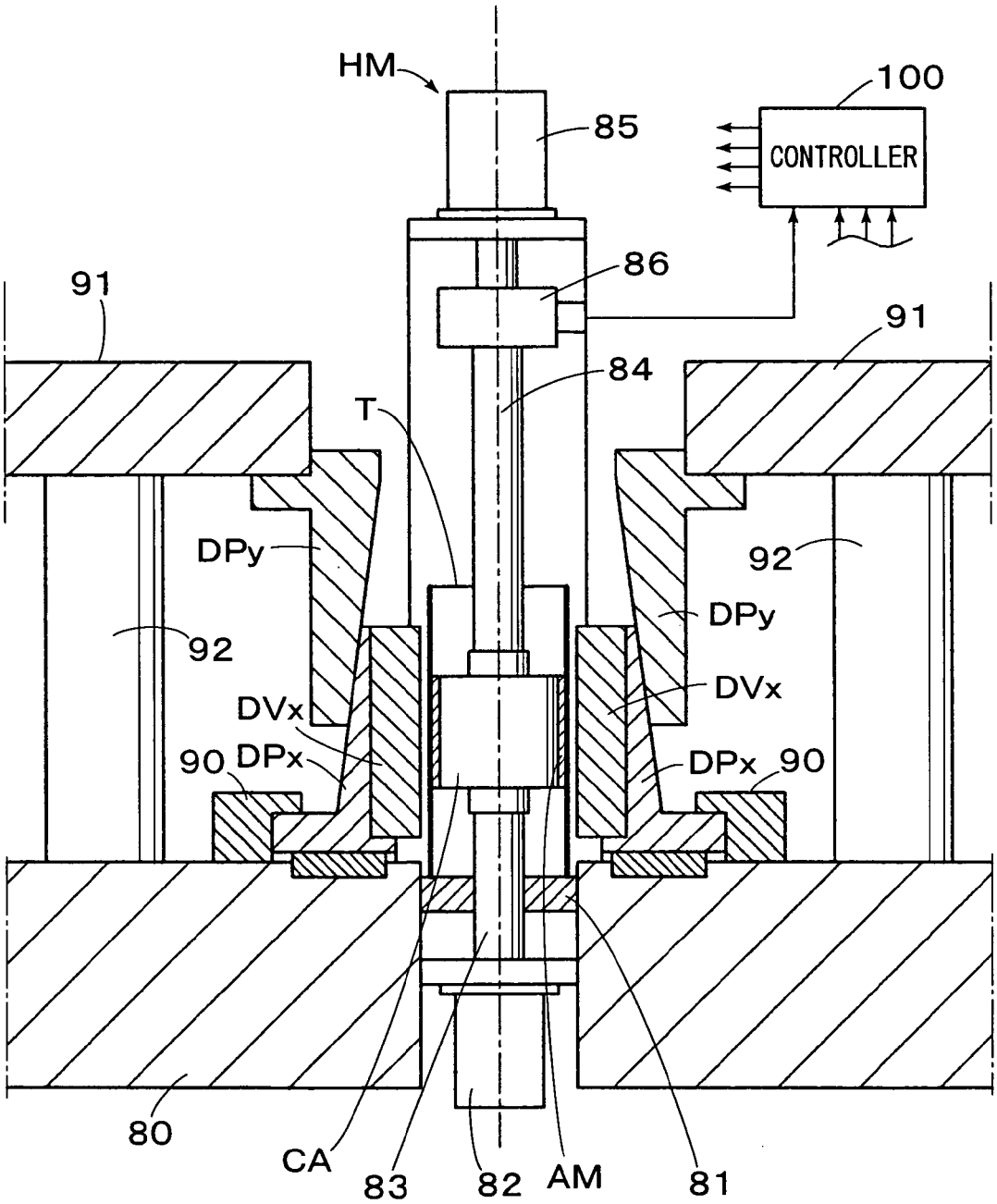
FIG. 15 is a sectional view showing a sizing apparatus for use in a method according to another embodiment of the present invention.

Referring to FIGS. 15–18, will be described hereinafter another embodiment of the present invention, which is adapted to provide a most appropriate inner diameter of the cylindrical housing for the sizing process, on the basis of the relationship between the axial load and the inner diameter of the cylindrical housing, which is obtained when the honeycomb structure as shown in FIG. 1 is moved along the longitudinal axis relative to the cylindrical housing by a predetermined distance. FIG. 15 illustrates a sizing apparatus for use in the present embodiment, wherein a catalyst substrate holding device HM penetrates a base 80 to be supported thereon vertically. The substrate holding device HM includes a support 81 and a cylinder 82 fixed within a hole defined in the base 80, respectively, and a shaft 83 penetrates the support 81 to be slidably supported thereby and driven by the cylinder 82. Also, a shaft 84 whose end surface is held to face the end surface of the shaft 83, is supported by a cylinder 85 to move vertically. Between the shaft 84 and cylinder 85, a load cell 86 is disposed to measure an axial load, which will be applied by the cylinder 85 to the catalyst substrate CA through the shaft 84. The load cell 86 is electrically connected to a controller 100. The shafts 83 and 84 are served as a couple of supporting members of the present invention, as will be described later.

A plurality of split dies DPx which are supported by an annular frame 90 having a c-shaped cross section so as to slide in a radial direction (toward a longitudinal axis) on the base 80. The split dies DPx have compressing members DVx secured to their inner sides. Each split die DPx has a tapered outer (back) surface, to be slidably fitted into the inside of a pushing die DPy, which has a tapered inner surface to contact and slide on the tapered outer surface of the die DPx. The pushing die DPy may be formed to provide a hollow cylinder, or provide split dies to contact the sprit dies DPx, respectively. The pushing die DPy is secured to a pushing plate 91, which is supported by a supporting member 92 on the base 80 to be movable vertically. Therefore, the pushing die DPy is moved by the pushing plate 91 vertically, e.g., downward in FIG. 15, the split dies DPx are moved radially (toward the longitudinal axis). The pushing plate 91 is actuated by a hydraulic pressure actuating device (not shown), which is controlled by the controller 100.

Figure 16:
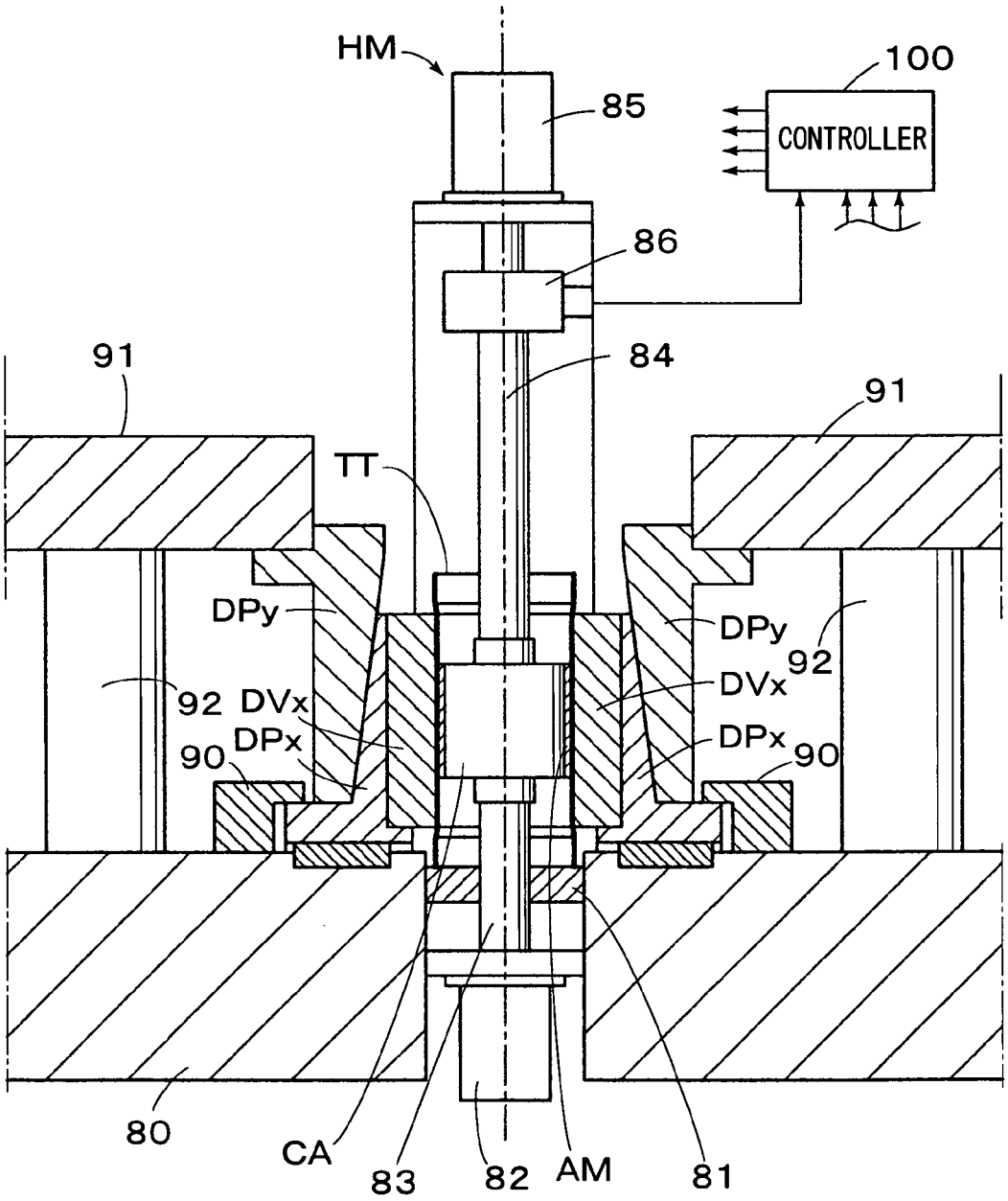
FIG. 16 is a sectional view showing a process for reducing a cylindrical housing by the sizing apparatus for use in the method according to another embodiment of the present invention.

In operation, the cylindrical housing T is placed on the upper surface of the support 81, with the shaft 83 placed on the longitudinal axis of the cylindrical housing T. Then, the catalyst substrate CA with the shock absorbent mat AM wrapped around it is loosely inserted into the cylindrical housing T (or, almost stuffed into it, with a few times of reduction estimated in advance), and placed on the tip end surface of the shaft 83. And, the shaft 84 is moved downward by the cylinder 85 to hold the catalyst substrate CA between its tip end surface and the tip end surface of the shaft 83. Then, the pushing plate 91 is actuated by the hydraulic pressure actuating device (not shown) to move the pushing die DPy downward in FIG. 15, so that the split dies DPx are moved radially toward the longitudinal axis of the cylindrical housing T. As a result, the body portion (intermediate portion) of the cylindrical housing T and the shock absorbent mat AM are compressed by the compressing members DVx to reduce the diameter of the cylindrical housing T as shown in FIG. 16, thereby to form the cylindrical housing TT. The reduced amount is controlled accurately by the hydraulic pressure actuating device which is controlled by the controller 100. Consequently, the catalyst substrate CA is held in a stable state within the cylindrical housing TT.

As described above, the sizing apparatus is controlled by the controller 100, and the sizing process by any amount of reduction can be achieved according to NC control, to enable a fine control. Furthermore, in the sizing process, a workpiece may be rotated occasionally to perform the index control, the cylindrical housing T can be reduced in diameter more uniformly about its entire periphery. The control medium for the sizing apparatus is not limited to the hydraulic pressure. With respect to its actuating and controlling system, any actuating system including a mechanical system, electric system, pneumatic system or the like may be employed, and preferably a CNC control system may be used.

Figure 17:
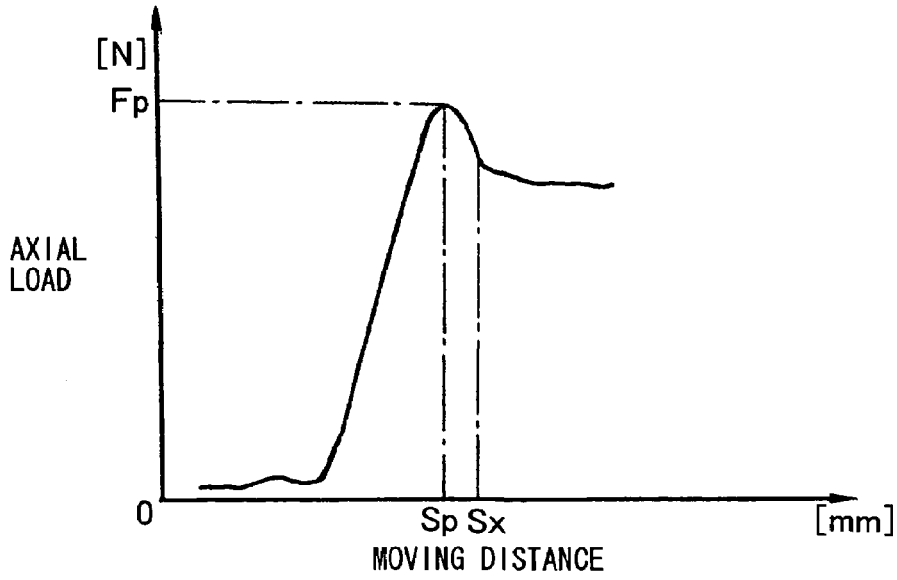
FIG. 17 is a diagram showing a relationship between an axially moving distance and axial load which is applied to a catalyst substrate, in such a state that a cylindrical housing is reduced to compress a shock absorbent member thereby to hold a catalyst substrate appropriately.

Next, referring to FIGS. 17 and 18, will be explained an embodiment of the preliminary shrinking process, wherein the body portion of the cylindrical housing T is reduced in diameter according to the plurality of shrinking processes (twice in the present embodiment) by means of the sizing apparatus as described above. FIG. 17 shows a relationship between an axially moving distance (i.e., stroke) of the catalyst substrate CA and axial load applied to the catalyst substrate CA, in the case where the catalyst substrate CA with the shock absorbent member AM wrapped around it is inserted into the cylindrical housing T, and then the predetermined longitudinal part of the cylindrical housing T is reduced to compress the shock absorbent member AM thereby to hold the catalyst substrate CA appropriately. As describe before, the frictional force between the shock absorbent mat AM and the catalyst substrate CA, and frictional force between the shock absorbent mat AM and the cylindrical housing T can be indicated by the product of multiplying the pressure reproduction force of the shock absorbent mat AM and the coefficient of static friction between the shock absorbent mat AM and the outer surface of the catalyst substrate CA, and the product of multiplying the pressure reproduction force of the shock absorbent mat AM and the coefficient of static friction between the shock absorbent mat AM and the inner surface of the cylindrical housing T, respectively. In this respect, as for the holding force in the axial (longitudinal) direction of the cylindrical housing T, the frictional force between the shock absorbent mat AM and the remaining one with the smaller coefficient of friction is dominant. With respect to the catalyst substrate CA and cylindrical housing T with known coefficients of static friction, therefore, the required frictional force is made clear.

As shown in FIG. 17, with the axially moving distance of the catalyst substrate CA increased, the axial load is increased to become its maximum value (Fp), which is called as drawing load, then rapidly reduced, and thereafter gradually reduced. Because the axial load corresponds to the frictional force between the shock absorbent mat AM and the one with the smaller coefficient of friction out of the substrate CA and the cylindrical housing T in this case, the axially moving distance (Sp, e.g., 1.5 mm) of the catalyst substrate CA, which is obtained when the axial load equals the drawing load (Fp), corresponds to the stroke capable of obtaining the maximum frictional force. It is not so easy to define the axially moving distance (Sp), because various conditions are combined together. However, if the catalyst substrate CA is moved by an axially moving distance (Sx) equal to or more than the value (Sp), the maximum frictional force, i.e., the drawing load (Fp) can be detected. Therefore, the axially moving distance (Sx) is set to be 2 mm (>Sp) for example, and the load is detected when the axial load equals the drawing load (Fp), in such a state that a proper compression load has been applied to the shock absorbent mat AM, and then the detected load is set to be a target (desired) axial load (Ft), in accordance with which the amount of shock absorbent mat AM to be compressed (i.e., the diameter of cylindrical housing T to be reduced) is adjusted, so that the desired frictional force can be obtained between the shock absorbent mat AM and the one with the smaller coefficient of friction out of the catalyst substrate CA and the cylindrical housing T.

Alternatively, may be monitored a coefficient of dynamic friction in a region of approximately stable state at a position where the axially moving distance is larger than the axially moving distance (Sx), i.e., a position at the right side to "Sx" in FIG. 17. In other words, it can be determined in accordance with an individual designing or processing condition, whether the sizing process is controlled on the basis of the peak value (maximum coefficient of static friction), or the sizing process is controlled on the basis of the maximum coefficient of dynamic friction (in a moving condition). In any case, it is sufficient to monitor only a relative movement of the one with the smaller frictional force, out of the frictional force between the shock absorbent mat and the catalyst substrate and the frictional force between the shock absorbent mat and the cylindrical housing, which will begin moving first. Thus, it is apparent that the catalytic converter can be produced easily according to the present embodiment.

Figure 18:
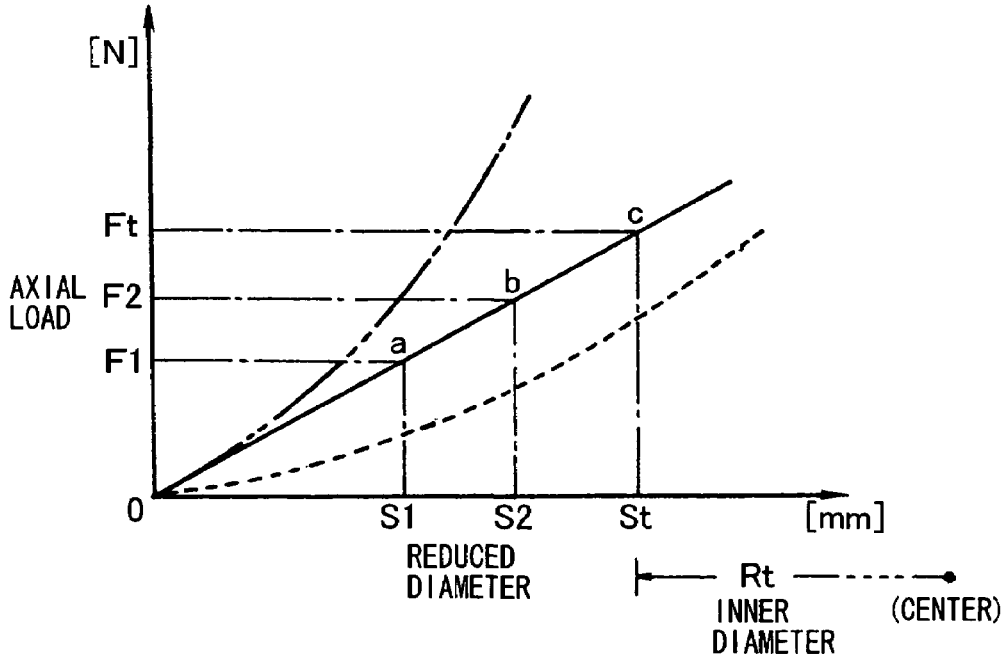
FIG. 18 is a diagram showing a relationship between a reduced amount of a cylindrical housing for applying a compression load to a shock absorbent mat and an axial load applied to a catalyst substrate.

FIG. 18 shows a relationship between the reduced amount of the cylindrical housing T for applying the compression load to the shock absorbent mat AM (abscissa), and the axial load applied to the catalyst substrate CA (ordinate). A correlation property according to the present embodiment indicates approximately straight line, as can be seen in FIG. 18 by a solid line located in the middle between a two-dotted chain line indicative of a property with the maximum load and a broken line indicative of a property with the minimum load. In FIG. 18, the relationship between the target axial load (Ft) provided when the compression load applied to the shock absorbent mat AM is most appropriate, and the target reduced amount (St) of cylindrical housing T capable of providing the target axial load (Ft), which are provided in accordance with the property as shown in FIG. 17, can be defined as follows. According to a first shrinking process, the shock absorbent mat AM is wrapped around the catalyst substrate CA, and these are loosely inserted into the cylindrical housing T. Then, a first reduced amount (S1) is measured, when a first shrinking process is performed to the predetermined longitudinal part of the cylindrical housing T for enclosing therein the shock absorbent mat AM, thereby to reduce the diameter of that part, and a first axial load (F1) is measured, when the axial load is applied to the catalyst substrate CA so as to move it along the longitudinal axis of the cylindrical housing T by the axially moving distance (Sx) as shown in FIG. 17, e.g., 2 mm. The first reduced amount (S1) obtained at a position "a" in FIG. 18 corresponds to a distance from the inner surface (position "0" in FIG. 18) of the cylindrical housing T before the shrinking process is performed, which distance can be measured by the radial moving distance of the split dies DPx, on the basis of the detected hydraulic pressure of the hydraulic pressure actuating device (not shown) for actuating the pushing plate 91.

Then, a second shrinking process is performed, and a second reduced amount (S2) is measured, when the second shrinking process is performed to the predetermined longitudinal part of the cylindrical housing T for enclosing therein the shock absorbent mat AM, thereby to reduce the diameter of that part, and a second axial load (F2) is measured, when the axial load is applied to the catalyst substrate CA so as to move it along the longitudinal axis of the cylindrical housing T (in the same direction as the moving direction when the first shrinking process was made) by the axially moving distance (e.g., 2 mm). In this process, the second reduced amount (S2) obtained at a position "b" in FIG. 18 corresponds to a distance from the inner surface (position "0" in FIG. 18) of the cylindrical housing T before the shrinking process is performed, which distance can be measured by the radial moving distance of the split dies DPx, on the basis of the detected hydraulic pressure of the hydraulic pressure actuating device (not shown) for actuating the pushing plate 91. Therefore, the moving distance between the position "a" and position "b" corresponds to (S2-S1).

Accordingly, on the basis of the correlation property between the first and second reduced amounts (S1 and S2) and the first and second axial loads (F1 and F2), can be estimated the target reduced amount (St) for holding the catalyst substrate CA in the cylindrical housing T by a predetermined target holding force, which corresponds to the target axial load (Ft). In the sizing process, the cylindrical housing T is sized to reduce its diameter, so as to provide the target reduced amount (St) which corresponds to the desired axial load (Ft) provided in advance as shown in FIG. 18. Alternatively, a target (desired) value (Rt in FIG. 18) may be provided for the inner diameter of the cylindrical housing T, i.e., the target value (Rt) may be provided in accordance with the correlation property between the first and second inner diameters (R1, R2), and the first and second axial loads (F1, F2), and the cylindrical housing T may be reduced in diameter until the target value (Rt) will be obtained. In this case, the inner diameter of the cylindrical housing T can be obtained by subtracting the moving distance of the compressing members DVx (the split dies DPx) from the predetermined distance between the initial position of the compressing members DVx and the longitudinal axis of the catalyst substrate CA.

The measurement as described above is made twice by moving the catalyst substrate CA against the cylindrical housing T, in the same axial direction, by the predetermined distance (2 mm), respectively, so that the catalyst substrate CA is displaced by 4 mm in total. Therefore, when the catalyst substrate CA is placed in the cylindrical housing T, the catalyst substrate CA may be originally placed on a position retracted backward by the total displacement of 4 mm, in a direction opposite to the moving direction of the catalyst substrate CA. Or, the catalyst substrate CA may be retracted backward by the total displacement in the direction opposite to the moving direction, after the cylindrical housing T was sized.

Alternatively, the measurement as described above may be made twice by moving the catalyst substrate CA against the cylindrical housing T, in the axial direction opposite to each other, by the predetermined distance (2 mm), respectively. Thus, if the direction is reversed every measurement, the displacement will be cancelled after the measurement is achieved twice. Preferably, the multiple measurements may be made in the same direction, as in the present embodiment, because fewer error will be expected, if the measurement is made in such a state that the force is applied to the shock absorbing mat AM in the same (constant) direction.

After the measurement is achieved twice as described above, the axial load may be measured at a position "c" in FIG. 18, as well. Generally, it can be estimated on the basis of the results measured at the two positions. Therefore, the measurement does not have to be made three times in a mass-production line for producing the converters. Also, in the case where it has been found that the correlation property is regressed to the straight line as shown in FIG. 18, it will be of almost no importance to measure the load at three or more positions, from the position "0" to the position "c" in FIG. 18. Specifically, the estimated correlation property line lies on a zone between the two curved lines including the straight line as shown in FIG. 18. In order to identify an appropriate point for the position "c" on the correlation line, therefore, it will be appropriate to measure the load at another one position other than the positions "a" and "b", and obtain a quadratic curve through a least square approximation on the basis of the measured three positions, and then identify the position "c" on the quadratic curve, whereby a more precise measurement could be achieved. In the mass-production of catalytic converters or the like according to the present invention, the above-described accuracy is not required. Therefore, the productivity is given priority according to the present embodiment, so that the linear regression based on only two positions as shown in FIG. 18 has been employed, so as to approximate the curve. If the axial movement of the catalyst substrate CA and the measurement of the axial load applied to the catalyst substrate CA can be made consecutively in the shrinking process of the cylindrical housing T, the load measurement may be made, moving the catalyst substrate CA.

Figure 21:
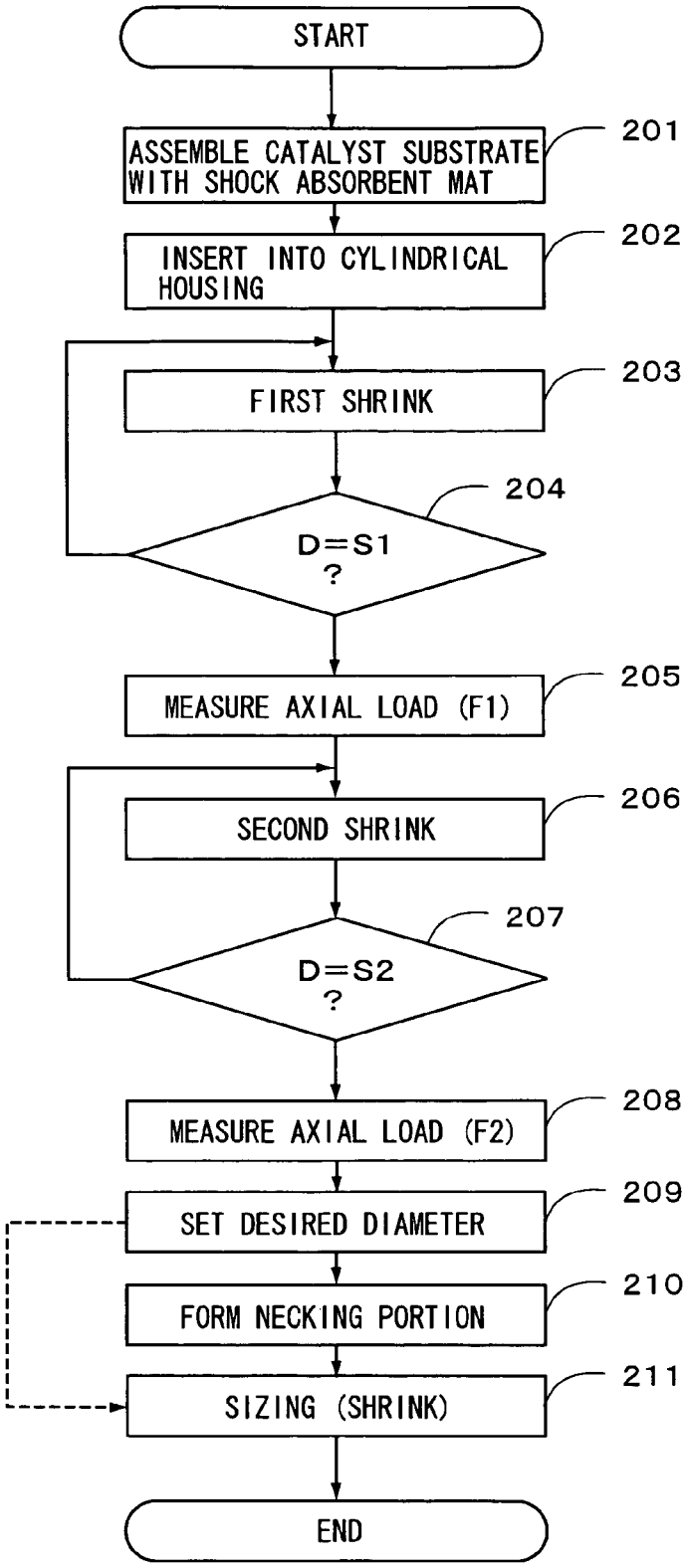
FIG. 21 is a flowchart showing an example of the method according to another embodiment of the present invention.

Referring to FIG. 21, a method for producing a product will be explained in accordance with processes made in sequence, as a practical embodiment of the method for producing the catalytic converter by means of the sizing apparatus as described above. At the outset, according to the same process as in the embodiment as shown in FIG. 20, the shock absorbent mat AM with its density of 1400 g/m$^2$±10% is assembled with (wrapped around) the outer surface of the catalytic substrate CA with its outer diameter of 103 mm ±1.0 mm at Step 201, and then the catalyst substrate CA with the shock absorbent mat AM wrapped around it is inserted into the cylindrical housing T at Step 202. Then, the program proceeds to Step 203 where a first preliminary shrinking is performed to measure a drawing load. At this stage, the catalyst substrate CA is not temporarily held, so that the outer diameter of the cylindrical housing T is reduced to become a predetermined outer diameter S1 (e.g., 121 mm) between the diameter of 124 mm and 117.8 mm, and the axial load F1 (corresponding to a maximal holding force at this stage) is measured at Step 205.

Next, a second preliminary shrinking is performed at Step 206, so that the outer diameter of the cylindrical housing T is reduced to become a predetermined outer diameter S2 (e.g., 117.8 mm) at Step 207, whereby the catalyst substrate CA is temporarily held, as in the same state as the previous embodiment. Then, the axial load F2 (a maximal holding force) at this stage is measured at Step 208. On the basis of the axial loads F1 and F2, and reduced amounts correspond thereto respectively, the property as shown in FIG. 18 is provided. If the pressure to be produced by the shock absorbent mat AM to hold the catalyst substrate CA in the cylindrical housing T most appropriately is plotted along property as shown in FIG. 18, the most appropriate amount of the cylindrical housing T to be reduced for producing the most appropriate pressure can be defined. Thus, the most appropriate amount to be reduced in diameter is set at Step 209, and the most appropriate outer diameter of the cylindrical housing TT (e.g., 114.0 mm) can be obtained. Then, the program proceeds to Step 210 where the necking process is applied to the opposite ends of the cylindrical housing TT, and proceeds to Step 211 where the sizing process is performed to reduce the diameter of the body portion (intermediate portion) of the cylindrical housing TN for receiving therein the catalyst substrate CA and the absorbent mat AM, until the outer diameter of the body portion will come to be the outer diameter (114.0 mm) as obtained in the above. Consequently, the catalyst substrate CA is held in the cylindrical housing TN with the shock absorbent mat AM producing the appropriate pressure applied to the catalyst substrate CA.

As explained above, according to the present embodiment, the appropriate amount to be reduced in diameter can be obtained as a result of the preliminary shrinking process (i.e., after it was temporarily fixed), without providing the measurement process (Step 102) as required in the embodiment as shown in FIG. 20, whereby the product can be produced easily and rapidly. Furthermore, the appropriate amount to be reduced in diameter can be obtained as a result of the compressing process as explained hereinafter.

Figure 22:
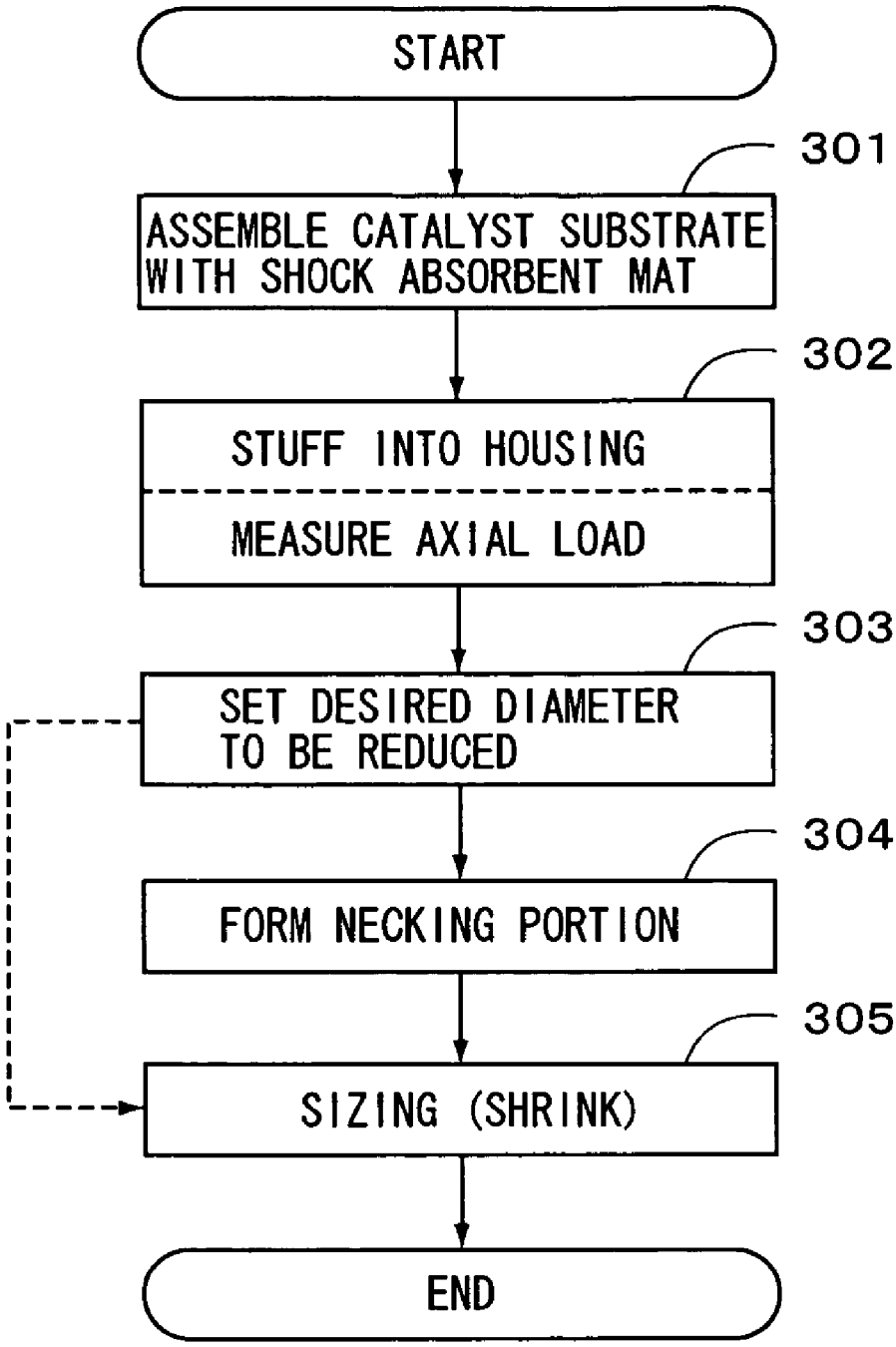
FIG. 22 is a flowchart showing an example of the method according to a further embodiment of the present invention.

FIG. 22 shows a further embodiment which is adapted to produce a catalytic converter by means of a stuffing device (not shown) for stuffing (pressing) the catalyst substrate CA with the shock absorbent mat AM wrapped around it into the cylindrical housing T, according to processes as will be explained hereinafter in sequence. At the outset, the shock absorbent mat AM with its density of 1400 g/m$^2$±10% is assembled with (wrapped around) the outer surface of the catalytic substrate CA with its outer diameter of 103 mm±1.0 mm at Step 301, and then the catalyst substrate CA with the shock absorbent mat AM wrapped around it is stuffed into the cylindrical housing T with its outer diameter of 117.8 mm, at Step 302, and a maximal axial load, i.e., maximal holding force (drawing load) is measured. Then, set and stored at Step 303 is a desired diameter to be reduced to produce the most appropriate pressure in combination of the catalyst substrate CA and the shock absorbent mat AM, on the basis of a relationship between the (measured) outer diameter of the cylindrical housing T stored in advance in the controller 100 and the drawing load. Next, the program proceeds to Step 304 where the necking portions are formed on the opposite ends of the cylindrical housing T in the same manner as described before, and further to Step 305 where the sizing process is performed to reduce the outer diameter of the body portion (intermediate portion) of the cylindrical housing T for receiving therein the catalyst substrate CA and the absorbent mat AM, until the outer diameter of the body portion will come to be the desired outer diameter to be reduced.

According to the embodiment by stuffing, in the case where there is a variation in the outer diameter of the cylindrical housing T comparing with the outer diameter of 117.8 mm, if the outer diameter of the cylindrical housing T is measured, and the measured result is taken into consideration in the sizing process, then the accuracy will be improved. Although the absorbent mat AM might be affected by shearing force caused when stuffed (pressed), the processes in the present embodiment have been simplified, comparing with the embodiment including the preliminary shrinking process. In the case where severe accuracy is not required for the pressure to be produced by the absorbent mat AM, the embodiment including the stuffing process as described above may be employed. As for a stuffing device used in the present embodiment, the device does not have to be so complicated comparing with the device as shown in FIG. 15, but may be made simple, by installing a pressure sensor (e.g., load cell) on the pushing member, for example.

Figure 23:
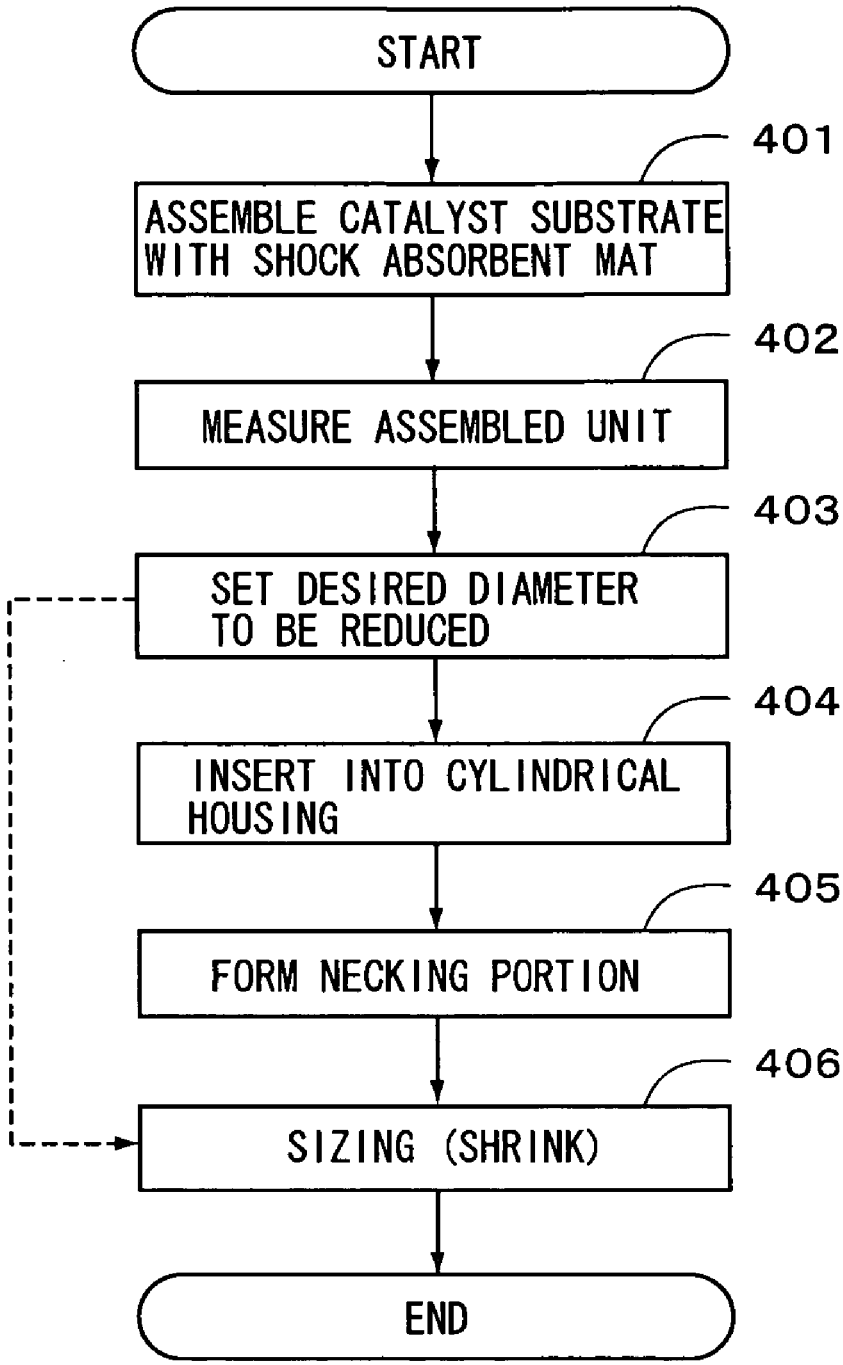
FIG. 23 is a flowchart showing an example in the method according to yet further embodiment of the present invention.

As for a yet further embodiment, FIG. 23 shows a method for producing a catalytic converter by sizing the cylindrical housing T holding therein the catalyst substrate CA with the shock absorbent mat AM wrapped around it, without providing the preliminary shrinking process, according to processes as will be explained hereinafter in sequence, with reference to FIG. 19. After the shock absorbent mat AM with its density of 1400 g/m$^2$±10% was assembled with (wrapped around) the outer surface of the catalytic substrate CA with its outer diameter of 103 mm±1.0 mm at Step 401, the catalyst substrate CA with the shock absorbent mat AM wrapped around it is measured at Step 402, as described before, and the desired diameter to be reduced for the cylindrical housing T with its outer diameter of 124 mm ±0.4 mm is set at Step 403. For example, the desired diameter to be reduced is set enough to obtain the outer diameter of the cylindrical housing T (e.g., 114.0 mm), wherein the absorbent mat AM is capable of producing the most appropriate pressure in the cylindrical housing T, and the desired diameter to be reduced is stored in the controller 100.

Figure 19:
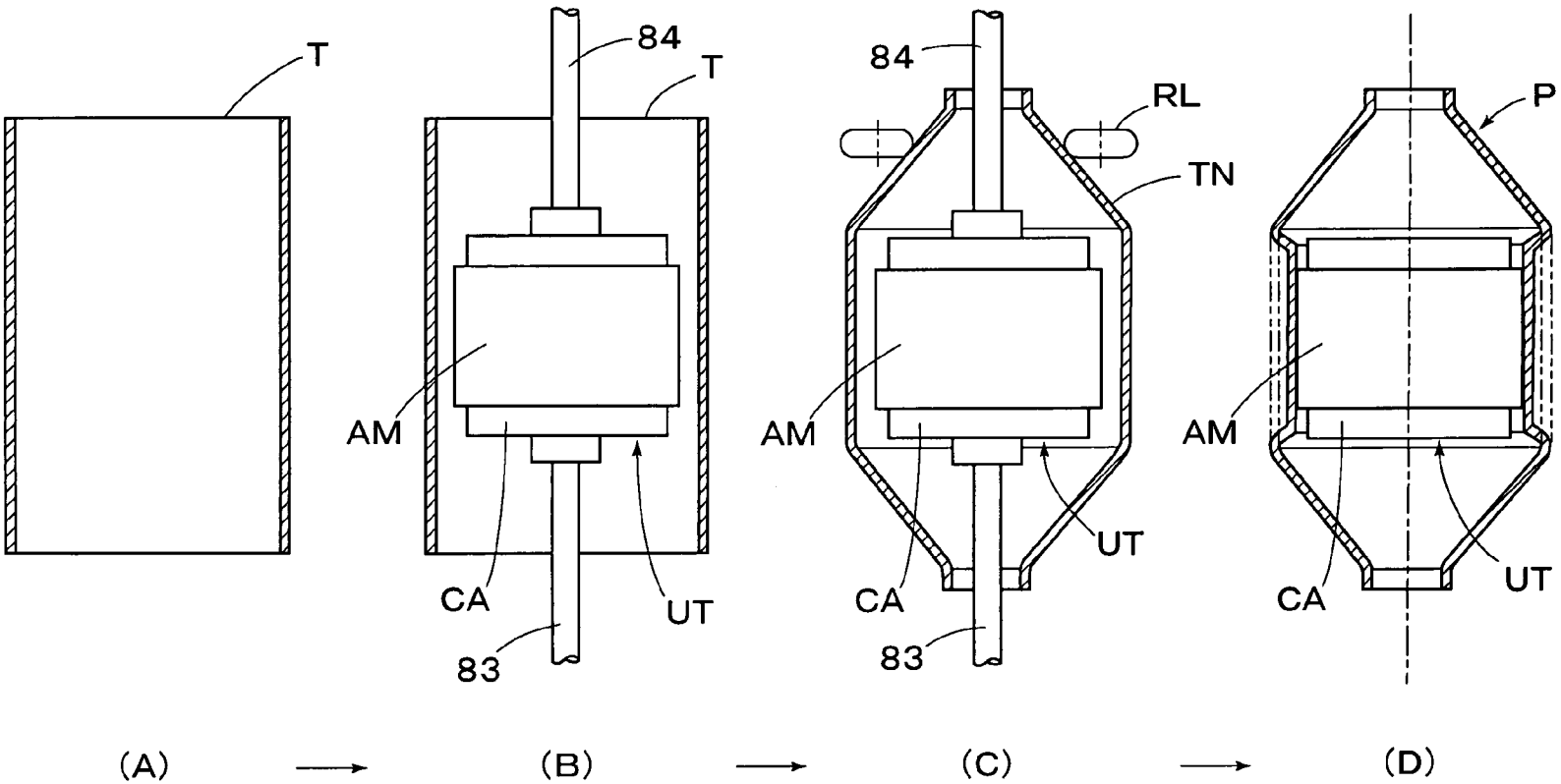
FIG. 19 is a block diagram showing an example of a process in the method according to yet further embodiment of the present invention.

Then, the program proceeds to Step 404 where the assembled unit UT, with the absorbent mat AM wrapped around the catalyst substrate CA, is inserted into the cylindrical housing T, and shafts 83 and 84 are inserted into the cylindrical housing T along its longitudinal axis as shown in (B) of FIG. 19, by means of the same device as the one shown in FIG. 15, whereby the assembled unit UT can be held in the body portion of the cylindrical housing T without contacting the inner surface thereof. Thus, the shafts 83 and 84 are movably disposed away from and close to opposite ends of the catalyst substrate CA along the longitudinal axis of the cylindrical housing T, respectively, and contact the opposite ends of the catalyst substrate CA to hold the assembled unit UT in the cylindrical housing T. And,.without performing the preliminary shrinking process, the program proceeds to Step 405 where the necking portions are formed on the opposite ends of the cylindrical housing T by means of the spinning apparatus 1 as shown in FIGS. 4 and 5 to produce the cylindrical housing TN. The necking process is performed by means of the spinning apparatus 1 as shown in (C) of FIG. 19. That is, the assembled unit UT is pressed by the shafts 83 and 84 in the axial direction to be held between them, and then each end portion of the cylindrical housing T is formed by the spinning rollers RL. In this case, the force applied by the shafts 83 and 84 to hold the assembled unit UT may be as small as it will not damage the catalyst substrate CA and the assembled unit UT will not move during the spinning process. Although the co-axial spinning process is performed as shown in (C) of FIG. 19, it is possible to form the necking portion along the axis offset to or oblique to the axis of the body portion of the cylindrical housing T, as far as the shafts 83 and 84 will not interfere with the cylindrical housing T.

Then, the program further proceeds to Step 406 in FIG. 23, where the sizing process is performed by means of the device as shown in FIG. 15, to reduce the diameter of the body portion (intermediate portion) of the cylindrical housing TN for receiving therein the catalyst substrate CA and the absorbent mat AM as shown in (D) of FIG. 19, until the outer diameter of the body portion will come to be the outer diameter (114.0 mm) as set at Step 403. Consequently, the catalyst substrate CA is held in the cylindrical housing TN with the shock absorbent mat AM producing the appropriate pressure applied to the catalyst substrate CA. According to the present embodiment, therefore, the processes are made simple, with a small variation, comparing with the previous embodiment including the preliminary shrinking process. In the case where severe accuracy is not required for the pressure to be produced by the absorbent mat AM, therefore, the embodiment as described above with reference to FIGS. 19 and 23 may be employed.

Although the number of the catalyst substrate CA is one according to the embodiments as described above, two substrates may be arranged along the longitudinal axis to provide a tandem type, or more than two substrates may be aligned. In the latter cases, the shrinking process may be applied to every body portion of the cylindrical housing covering each honeycomb member, or may be applied to the entire housing continuously. Furthermore, the co-axial necking process can be applied effectively. And, the process as described above may be adapted to produce the finished products of not only the exhaust parts for automobiles, but also various fluid treatment devices including the reformer for use in the fuel cell as described before, or the like.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method for producing a fluid treatment device having a honeycomb member in a metallic cylindrical housing with a shock absorbent member wrapped around the honeycomb member, comprising:

inserting the honeycomb member with the shock absorbent member wrapped around the honeycomb member into the cylindrical housing;

forming a necking portion on at least one end portion of the cylindrical housing, with a body portion thereof being clamped; and reducing a diameter of at least a part of the cylindrical housing with the shock absorbent member received therein, to reduce an outer diameter of the shock absorbent member, to such an extent that a desired inner diameter of the part of the cylindrical housing is provided enough to cause the shock absorbent member to produce a desired holding pressure for holding the honeycomb member in the cylindrical housing solely by the shock absorbent member, wherein the desired inner diameter of the cylindrical housing is provided based on a monitored axial load applied to the honeycomb member after the honeycomb member having the wrapped shock absorbent member is inserted into the cylindrical housing.

2. The method of claim 1, wherein the honeycomb member with the shock absorbent member wrapped around the honeycomb member is stuffed into the cylindrical housing.

* * * * *